US005923312A

United States Patent [19]

Okada et al.

[11] Patent Number: 5,923,312

[45] **Date of Patent: *Jul. 13, 1999**

[54] DRIVING CIRCUIT USED IN DISPLAY APPARATUS AND LIQUID CRYSTAL DISPLAY APPARATUS USING SUCH DRIVING CIRCUIT

[75] Inventors: Hisao Okada, Ikoma; Yuji Yamamoto, Kobe; Sunao Etou, Tenri; Kuniaki Tanaka, Nara, all of Japan

[73] Assignee: Sharp Kabushiki Kaisha, Osake, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/477,789

[22] Filed: Jun. 7, 1995

[30] Foreign Application Priority Data

Oct. 14, 1994 [JP] Japan ..... 6-249598

[51] Int. Cl.[6] ..... G04G 3/36

[52] U.S. Cl. ..... 345/95; 345/87; 345/89; 345/94

[58] Field of Search ..... 345/94, 87, 89, 345/95, 99

[56] References Cited

U.S. PATENT DOCUMENTS

| | | | |
|---|---|---|---|
| 3,955,187 | 5/1976 | Bigelow | 340/324 |
| 4,348,666 | 9/1982 | Ogita . | |
| 4,745,403 | 5/1988 | Tamura . | |
| 4,752,774 | 6/1988 | Clerc et al. . | |
| 4,824,211 | 4/1989 | Murata | 350/332 |
| 4,834,510 | 5/1989 | Fujita | 350/350 |
| 4,908,613 | 3/1990 | Green . | |
| 4,998,099 | 3/1991 | Ishii . | |
| 5,010,327 | 4/1991 | Wakita et al. . | |
| 5,066,945 | 11/1991 | Kanno et al. . | |
| 5,162,786 | 11/1992 | Fukuda . | |

FOREIGN PATENT DOCUMENTS

| | | |
|---|---|---|
| 0 171 547 | 2/1986 | European Pat. Off. . |
| 0 387 550 | 9/1990 | European Pat. Off. . |
| 0 391 655 | 10/1990 | European Pat. Off. . |
| 0 433 054 A2 | 6/1991 | European Pat. Off. . |
| 0488516A3 | 3/1992 | European Pat. Off. . |
| 0 515 191 A2 | 11/1992 | European Pat. Off. . |
| 0 624 862 A2 | 11/1994 | European Pat. Off. . |

(List continued on next page.)

OTHER PUBLICATIONS

H. Okada et al., *SID 94 DIGEST*, pp. 347–350, 1994 "An 8–bit Digital Data Driver for AMLCDs".

H. Okada et al., *SID 93 Digest*, pp. 11–14, 1993 "TFT–L-CDs Using Newly Designed 6–bit Digital Data Drivers".

*IBM Technical Disclosure Bulletin*, vol. 33, No. 6B, pp. 384–385, 1990 "Driving Method for TFT/LCD Grayscale".

*Primary Examiner*—Richard A. Hjerpe
*Assistant Examiner*—Kent Chang
*Attorney, Agent, or Firm*—David G. Conlin; Brian L. Michaelis

[57] ABSTRACT

A driving circuit used in a display apparatus includes a plurality of output circuits for selecting two reference gradation voltages among a plurality of different reference gradation voltages based on display data and outputting an interpolation voltage corresponding to the display data using the two reference gradation voltages; and a plurality of supply lines for supplying the plurality of reference gradation voltages. The supply lines including a plurality of voltage supply lines and a plurality of signal supply lines. One of the plurality of voltage supply lines supplies a voltage having a minimum difference from the voltage of a common electrode of the display apparatus and another of the plurality of voltage supply lines supplies a voltage having a maximum difference from the voltage of the common electrode. The two reference gradation voltages selected by each of the output circuits are supplied by one of a plurality of pairs of supply lines. At least one of the pair has a signal supply line and a supply line having a voltage higher than the signal supply line, and another of the pairs has a signal supply line and a voltage supply line having a voltage lower than the signal supply line.

10 Claims, 28 Drawing Sheets

FOREIGN PATENT DOCUMENTS

| | | |
|---|---|---|
| 60-257683 | 12/1985 | Japan . |
| 3-89392 | 4/1991 | Japan . |
| 3-89393 | 4/1991 | Japan . |
| 4-136983 | 5/1992 | Japan . |
| 4-140787 | 5/1992 | Japan . |
| 5-35202 | 2/1993 | Japan . |
| 5-100630 | 4/1993 | Japan . |
| 5-100635 | 4/1993 | Japan . |
| 05158439 | 6/1993 | Japan . |
| 5-504213 | 7/1993 | Japan . |
| 5-224631 | 9/1993 | Japan . |
| 6-27900 | 2/1994 | Japan . |

(a) Output when display data is 1

(b) Output when display data is 3

(c) Output when display data is 4

(d) Output when display data is 6

DRIVING CIRCUIT USED IN DISPLAY APPARATUS AND LIQUID CRYSTAL DISPLAY APPARATUS USING SUCH DRIVING CIRCUIT

BACKGROUND OF THE INVENTION

1. Field of the Invention

The present invention relates to a driving circuit used in a display apparatus and a liquid crystal display apparatus using such a driving circuit, and in particular to a planar display apparatus, especially, an active matrix liquid crystal display apparatus for displaying an image having multiple gray-scale levels and a driving circuit used in the same.

2. Description of the Related Art

The conventional oscillating voltage method will be described. The conventional oscillating voltage method is disclosed in Japanese Laid-Open Patent Publication No. 6-27900 (Japanese Patent Publication No. 7-7248) which is assigned to the same assignee with the present invention. The oscillating voltage method is used in a display apparatus in order to display an image having multiple gray-scale levels. The display apparatus includes a matrix display panel which has a plurality of pixels arranged in a matrix. The image formation is performed by supplying each of the pixels with a scanning voltage (gate voltage) and a driving voltage corresponding to display data having gray-scale information. In detail, a driving voltage having an oscillating component is sent to a source line (signal line) and then transmitted through an electric circuit acting as a low-pass filter. As a result, an average voltage obtained by suppressing the oscillating component of the driving voltage is applied to each of the pixels. The pixel which is supplied with the average voltage has been scanned in one scanning period by a scanning voltage. Accordingly, the average voltage supplied to the pixel corresponds to a gray scale level of the display data in one scanning period. In this manner, multiple gray-scale display is performed.

A liquid crystal display panel includes a plurality of source lines and a plurality of pixels. The resistance components and the capacitance components of the source lines and the pixels act as a low-pass filter. In the case where a storage capacitor is provided, the liquid crystal capacitance components and the storage capacitance components of the source lines and the pixels also act as a low-pass filter together with the resistance components and the capacitance components thereof. In other words, such components average the driving voltage having an oscillating component sent to each source line. Accordingly, a constant voltage is applied to the pixels. The resistance components and the capacitance components of the pixel selected by the scanning voltage in one scanning period and the source line connected to such a pixel act as a load for an output circuit. In this specification, such a source line and a pixel are referred together simply as a "load".

With reference to FIGS. 13 and 14, a conventional 3-bit driving device used in a liquid crystal display apparatus will be described. FIG. 13 shows a configuration of one of a plurality of output circuits (output circuit 500*a*) contained in a 3-bit digital driving device 500 configured as an LSI, and FIG. 14 schematically shows a configuration of a selection control section 530 in relation with the other components of the 3-bit driving device 500.

The 3-bit driving device 500 is used for driving a liquid crystal display panel in a liquid crystal display apparatus using the oscillating voltage method. As is shown in FIG. 14, the 3-bit driving device 500 includes a plurality of output circuits each provided for a source line (load) of the liquid crystal display panel. The 3-bit driving device 500 further includes voltage supply lines 10, 12, 15 and 17 respectively for supplying reference gray-scale voltages V0, V2, V5 and V7 sent from outside the 3-bit driving device 500 to the output circuits. The voltage supply lines 10, 12, 15 and 17 are respectively connected to voltage input terminals 1 through 4 provided at an end of the 3-bit driving device 500.

The output circuit 500*a* shown in FIG. 13, which is one of such output circuits, outputs gray-scale voltages based on data signals D0, D1 and D2 forming 3-bit display data to the corresponding source lines. The output circuit 500*a* includes a sampling circuit 510 for sampling the data signals D0, D1 and D2 based on a control signal Tsmp, a holding circuit 520 for storing an output from the sampling circuit 510 using a control signal LS, and a selection control section 530 for outputting a gray-scale voltage having a prescribed level, based on memory data d0 through d2 stored in the holding circuit 520.

As is shown in FIG. 14, the selection control section 530 includes a switch section 530*b* having four analog switches ASW0, ASW2, ASW5, and ASW7 respectively connected to the voltage supply lines 10, 12, 15 and 17, and a selection control circuit 530*a* for closing and opening the analog switches ASW0, ASW2, ASW5 and ASW7 based on the memory data d0, d1 and d2 stored in the holding circuit 520 and selecting two prescribed reference gray-scale voltages among the four reference gray-scale voltages V0, V2, V5 and V7.

The selection control circuit 530*a* is supplied with memory data d0 through d2 and a signal T3 shown in FIG. 15 having a duty ratio of 2:1. The memory data d0 through d2 and the signal T3 are used for the above-mentioned switching of the analog switches ASW0, ASW2, ASW5 and ASW7.

The conventional 3-bit driving device 500 having the above-described structure operates in the following manner.

Table 1 shows a logic configuration of the selection control circuit 530*a*, namely, the relationship between input and output.

TABLE 1

| Display data | | | | Output from the selection control circuit | | | |
|---|---|---|---|---|---|---|---|
| Decimal number | d2 | d1 | d0 | S0 | S2 | S5 | S7 |
| 0 | 0 | 0 | 0 | 1 | | | |
| 1 | 0 | 0 | 1 | $\overline{\tau 3}$ | $\tau 3$ | | |
| 2 | 0 | 1 | 0 | | 1 | | |
| 3 | 0 | 1 | 1 | | $\tau 3$ | $\overline{\tau 3}$ | |
| 4 | 1 | 0 | 0 | | $\overline{\tau 3}$ | $\tau 3$ | |
| 5 | 1 | 0 | 1 | | | 1 | |
| 6 | 1 | 1 | 0 | | | $\tau 3$ | $\overline{\tau 3}$ |
| 7 | 1 | 1 | 1 | | | | 1 |

In Table 1; 3-bit display data, which is to be sent to the selection control circuit 530*a*, is formed of memory data d0, d1 and d2. Signals s0, s2, s5 and s7, which are output from the selection control circuit 530*a*, are control signals respectively for the analog switches ASW0, ASW2, ASW5 and ASW7. Symbol $\tau 3$ indicates a value which becomes "1" when the signal T3 is "high" and becomes "0" when the signal T3 is "low". Symbol $\overline{\tau 3}$ indicates a value which becomes "1" when the signal T3 is low and becomes "0" when the signal T3 is high. The blank columns indicate that the control signal is "0".

For example, when the value of the display data is 1 (d2=0, d1=0, d0=1), the control signal s0 has a waveform obtained by inverting the waveform of the signal T3, and the control signal s2 has the same waveform as that of the signal T3. In the case that the analog switches ASW0, ASW2, ASW5 and ASW7 are controlled to be "ON" when the control signals s0, s2, s5 and s7 are "high" respectively, a signal for selecting the reference gray-scale voltages V0 and V2 having a duty ratio of 1:2 is obtained as is shown in waveform (a) in FIG. 16.

By setting the cycle of the waveform (a), namely, the cycle of the signal T3 to be sufficiently shorter than the cycle of the cut-off frequency of a low-pass filtering function of the liquid crystal display panel, a DC voltage which has an average value of the oscillating voltages is provided to pixels.

Waveforms (b), (c) and (d) respectively correspond to the outputs from the output circuit 500*a* when the values of the display data are 3, 4, and 6. Table 2 shows the relationship between the display data sent to the 3-bit driving device 500 and the output from the 3-bit driving device 500.

TABLE 2

| Display data | | | | Output from |
|---|---|---|---|---|
| Decimal number | D2 | D1 | D0 | the driving device V |
| 0 | 0 | 0 | 0 | $V_0$ |
| 1 | 0 | 0 | 1 | $\frac{V_0+2V_2}{3}$ |
| 2 | 0 | 1 | 0 | $V_2$ |
| 3 | 0 | 1 | 1 | $\frac{2V_2+V_5}{3}$ |
| 4 | 1 | 0 | 0 | $\frac{V_2+2V_5}{3}$ |
| 5 | 1 | 0 | 1 | $V_5$ |
| 6 | 1 | 1 | 0 | $\frac{2V_5+V_7}{3}$ |
| 7 | 1 | 1 | 1 | $V_7$ |

Hereinafter, how a current flows in the 3-bit driving device 500 when the oscillating voltages are applied will be described. In the following explanation, the value of the display data is 1.

FIG. 17 illustrates a detailed waveform of the output from the 3-bit driving device 500 shown as waveform (a) in FIG. 16 when the reference gray-scale voltages have the relationship of V0>V2. In FIG. 17, the rightward arrow (Iv0) indicates the direction of the current flowing from the 3-bit driving device 500 to the load. The leftward arrow (Iv2) indicates the direction of the current flowing from the load to the 3-bit driving device 500.

In time duration T1 during which the reference gray-scale voltage V0 is output, the load has a potential lower than that of the reference gray-scale voltage V0 after a transition period. Thus, the current Iv0 flows from the voltage supply line 10 to the load through the analog switch ASW0 (FIG. 14). Where the "ON" resistance of the analog switch ASW0 is rON, the total resistance between the output terminal of the 3-bit driving device 500 and the pixel electrode is RL, and the potential of the pixel is Vp, the level of the current Iv0 is:

$$|Iv0|=(V0-Vp)/(rON+RL).$$

In time duration T2 in which the reference gray-scale voltage V2 is output, the load has a potential higher than that of the reference gray-scale voltage V2. Thus, the current Iv2 flows from the load to the voltage supply line 12 through the analog switch ASW2 (FIG. 14). The level of the current Iv0 is:

$$|Iv2|=(Vp-V2)/(rON+RL).$$

When a sufficient length of time has passed after a prescribed oscillating voltage is applied to the load, the potential of the pixel is:

$$Vp=(V0+2\times V2)/3.$$

Accordingly, |Iv0|=2×|Iv2|.

In consideration of the voltage drop caused by the resistance, the circulation theory needs to be considered to obtain the potential Vp of the pixel from a mathematical point of view. However, since the gist of the present invention is not in presenting a mathematically precise proof, detailed explanation on how to find such a precise potential of the pixel will be omitted here.

In a driving device used in practice, the output circuit 500*a* shown in FIG. 13 is required for each of a plurality of source lines of the liquid crystal display panel. In order to drive a VGA type display panel, for example, 1920 output circuits are necessary. It is not practical to provide such a large number of circuits in one driving device. Accordingly, for example, 16 driving devices each including 120 circuits are used to drive one liquid crystal display panel. In each of such driving devices, each reference gray-scale voltage is supplied to the corresponding analog switch of the output circuits through the voltage supply line.

FIG. 18 shows how the reference gray-scale voltage V0 supplied by the voltage supply line 10 and the reference gray-scale voltage V2 supplied by the voltage supply line 12 are sent from the input terminals 1 and 2 of the driving device to the load through the analog switches ASW0 and ASW2.

The voltage supply lines 10 and 12 each have a resistivity ρ. Distance L0(i) between the input terminal 1 and the output circuit corresponding to the "i"th load (hereinafter, referred to as the "i"th output circuit) 500*i* is equal to distance L2(i) between the input terminal 2 and the "i"th output circuit 500*i*. Accordingly, the distances L0(i) and L2(i) will be collectively referred to simply as L(i), hereinafter.

Referring to FIG. 18, the resistance between the input terminal 1 or 2 and the "i"th output circuit 500*i* is ρ·L(i). Accordingly, a voltage drop occurs in the voltage supply line 10 by the current Iv0(i) flowing between the "i"th output circuit 500*i* and the "i"th load, and a voltage rise occurs in the voltage supply line 12 by the current Iv2(i) flowing between the "i"th output circuit 500*i* and the "i"th load.

Where the voltages at the input terminals 1 and 2 are respectively V0(0) and V2(0), the voltages V0(i) and V2(i) at the positions which are away from the input terminals 1 and 2 by distance L(i) are:

$$V0(i)=V0(0)-\rho\cdot L(i)|Iv0(i)|$$

$$V2(i)=V2(0)+\rho\cdot L(i)|Iv2(i)|.$$

Accordingly, the potential of the pixel is expressed by is the following equation.

$$\frac{V_{0(i)} + 2V_{2(i)}}{3} = \frac{\{V_{0(0)} - \rho \cdot L_{(i)}|I_{V0(i)}|\} + 2\{V_{2(0)} + \rho \cdot L_{(i)}|I_{V2(i)}|\}}{3}$$

From the above-described principle, $$|Iv\mathbf{0}(i)| = 2 \cdot |Iv\mathbf{2}(i)|.$$

By substituting this into the above equation, $$\frac{V_{0(0)} + 2V_{2(0)}}{3}$$

is obtained.

This indicates that, in consideration of only the "i"th output circuit, the phenomenon does not occur that the voltage supplied to the "i"th load changes by the influence of the current which flows to the output circuit to drive the "i"th load.

Accordingly, in the case that an oscillating voltage corresponding to the display data 1 (interpolation gray-scale voltage) is supplied through all the output terminals of the driving device 500, the currents flowing to all the output circuits for driving the respective loads provide all the loads, namely, all the pixels with a uniform voltage.

In the case that the output circuits corresponding to two adjacent source lines (loads) respectively output the display data 1 and 3, the driving device 500 operates in the following manner.

FIG. 19 shows waveforms of the voltages of the outputs from the driving device 500. Between the output circuit outputting the display data 1 and the corresponding load, the current Iv0 flows through the voltage supply line 10 and the current Iv2 flows through the voltage supply line 12. Between the output circuit outputting the display data 3 and the corresponding load, the current Iv2' flows through the voltage supply line 12 and the current Iv5 flows through the voltage supply line 15.

The currents Iv2 and Iv2' flow in opposite directions to each other. In other words, the current Iv2 which is caused by an oscillating voltage corresponding to the display data 1 and is to cause a voltage rise in the voltage supply line 12 is counteracted by the current Iv2' caused by an oscillating voltage corresponding to the display data 3.

In the case when the difference between the reference voltages V0 and V2 is substantially equal to the difference between reference voltages V2 and V5, the current Iv2 and Iv2' have almost the same absolute value and flow in opposite directions to each other. As a consequence, no voltage drop or voltage rise occurs in the voltage supply line 12 which supplies the reference gradation voltage V2.

However, a voltage drop occurs in the voltage supply line 10 which supplies the reference gradation voltage V0 with certainty. Therefore, the counteraction between the current flowing from the output circuit and the current flowing to the output circuit does not occur, and thus a change in the voltage supplied to the pixel is not compensated for. As a result, a gray-scale voltage Vp1 (interpolation gray-scale voltage; corresponding to the display data 1) supplied to the pixel is lowered.

FIGS. 20A and 20B illustrate the relationship between the reference gray-scale voltages V0 and V2 and the distance by which the currents Iv0 and Iv2 flow from the input terminals 1 and 2 of the voltage supply lines 10 and 12. A change in the voltage V1 (interpolation gray-scale voltage) applied to the pixels when the value of the display data is 1 with respect to the distance is also shown. FIG. 20A illustrates such relationship when all the outputs from the driving device 500 correspond to the display data 1. FIG. 20B illustrates such relationship when the outputs from two adjacent output circuits of the driving device 500 correspond to the display data 1 and 3 respectively.

In the case where all the outputs from the driving device 500 correspond to the display data 1, as is shown in FIG. 20A, the voltage V1 applied to the pixels is constant regardless of the distance.

In the case where the outputs from two adjacent output circuits of the driving device 500 correspond to the display data 1 and 3 respectively, as is shown in FIG. 20B, the voltage V1 applied to the pixels corresponding to the display data 1 decreases as the distance increases. The voltage V1 at distance x is lower than the voltage V1 at the input terminal by ΔV1.

In the output circuit outputting the display data 3, the current Iv2' which is to cause a voltage drop is counteracted by the current Iv2, and thus no voltage drop occurs in the voltage supply line 12 for supplying the reference voltage V2. In the voltage supply line 15 for supplying the reference voltage V5, a voltage rise occurs by the current Iv5. As a result, the resultant voltage corresponding to the display data 3 at distance x is higher than the voltage at the input terminal.

In the above explanation, the reference gray-scale voltages have the relationship of V0>V2>V5 (>V7). The voltage to be supplied to the pixels changes in the same manner when the relationship of the reference gray-scale voltages is V0<V2<V5 (<V7).

In the above explanation, some of the conditions are simplified. Such conditions will be described additionally, hereinafter.

In practice, the current flowing in each output circuit is one current component of the entire current which flows in each of the voltage supply lines. In the above explanation, a voltage drop or a voltage rise in the "i"th output circuit is regarded as the sum of voltage drops or the voltage rises which are caused between the input terminal of each voltage supply line and the connection point of the voltage supply line and the "i"th output circuit.

Needless to say, for example, the current component in the "i−1"th output circuit causes a voltage drop or a voltage rise only between the input terminal of the voltage supply line and the connection point of the voltage supply line and the "i−1"th output circuit.

In the above description, each voltage supply line has an input terminal only at one end thereof. In practice, each voltage supply line often has an input terminal at both ends thereof. In such a case, analysis on the current is more complicated. The other conditions which are simplified in the above explanation are not directly related to the present invention and thus detailed explanation thereof will be omitted.

A conventional 6-bit driving device will be described.

FIG. 21 shows a configuration of one output circuit 600*a* of a 6-bit driving device 600. The output circuit 600*a* corresponds to one source line (load), and includes a sampling circuit 610 for sampling data signals D0 through D5 forming 6-bit display data based on a sampling signal Tsmp, a holding circuit 620 for storing an output from the sampling circuit 510, and a selection control section 630 for controlling a plurality of analog switches ASW8*i* (i=0, 1 . . . 8) based on memory data d0 through d5 in the holding circuit 620.

The selection control section 630 includes a switch section 630*b* having a plurality of analog switches ASW8*i*, and a selection control circuit 630*a* for controlling the plurality of analog switches ASW8*i* based on the memory data d0 through d5. Reference gray-scale voltages V8i (i=0, 1, . . . 8) are supplied to the switch section 630*b* from outside the 6-bit driving device 600 and output to the load through the respective analog switches ASW8*i*.

FIG. 22 shows a detailed configuration of the selection control circuit 630*a*. As is shown in FIG. 22, the selection control circuit 630*a* includes an interpolation signal generation circuit 631 and a voltage selection and modulation circuit 632. The selection control circuit 630*a* is supplied with four signals t1 through t4 respectively having duty ratios of 7:1, 6:2, 5:3 and 4:4 as are shown in FIG. 23. The interpolation signal generation circuit 631 forms eight signals having waveforms which respectively have duty ratios of 8:0, 7:1, 6:2, 5:3, 4:4, 3:5, 2:6 and 1:7 based on the four signals t1 through t4 and selects a prescribed signal among the eight signals based on the lower 3 bits d0, d1 and d2 of the 6-bit display data. The selected signal is output as an interpolation signal T.

The voltage selection and modulation circuit 632 controls the analog switches ASW8*i* based on the upper 3 bits d3 through d5 of the 6-bit display data and selects voltages forming pairs among the nine reference gray-scale voltages. The voltage selection and modulation circuit 632 further modulates the selected pair of voltages using the interpolation signal T generated by the interpolation signal generation circuit 631.

Table 3A shows a logical configuration of the interpolation signal generation circuit 631, and Table 3B shows a logical configuration of the voltage selection and modulation circuit 632.

TABLE 3A

| d2 | d1 | d0 | T |
|---|---|---|---|
| 0 | 0 | 0 | 1 |
| 0 | 0 | 1 | $\tau 1$ |
| 0 | 1 | 0 | $\tau 2$ |
| 0 | 1 | 1 | $\tau 3$ |
| 1 | 0 | 0 | $\tau 4$ |
| 1 | 0 | 1 | $\bar{\tau} 3$ |
| 1 | 1 | 0 | $\bar{\tau} 2$ |
| 1 | 1 | 1 | $\bar{\tau} 1$ |

TABLE 3B

| d5 | d4 | d3 | S0 | S8 | S16 | S24 | S32 | S40 | S48 | S56 | S64 |
|---|---|---|---|---|---|---|---|---|---|---|---|
| 0 | 0 | 0 | T | $\bar{T}$ | | | | | | | |
| 0 | 0 | 1 | | T | $\bar{T}$ | | | | | | |
| 0 | 1 | 0 | | | T | $\bar{T}$ | | | | | |
| 0 | 1 | 1 | | | | T | $\bar{T}$ | | | | |
| 1 | 0 | 0 | | | | | T | $\bar{T}$ | | | |
| 1 | 0 | 1 | | | | | | T | $\bar{T}$ | | |
| 1 | 1 | 0 | | | | | | | T | $\bar{T}$ | |
| 1 | 1 | 1 | | | | | | | | T | $\bar{T}$ |

The interpolation signal T from the interpolation signal generation circuit 631 is expressed by:

$$T=(0)+(1)\tau_1+(2)\tau_2+(3)\tau_3+(4)\tau_4+(5)\bar{\tau}_3+(6)\bar{\tau}_2+(7)\bar{\tau}_1$$

where numerical figures in parentheses ( ) are decimal numbers of the display data.

For example, when the display data is 4, (d2, d1, d0)=(1, 0,0). Accordingly, the interpolation signal generation circuit 631 selects the signal t4 based on Table 3A, and sends the signal t4 to the voltage selection and modulation circuit 632 as an interpolation signal T.

Since (d5, d4, d3)=(0,0,0), the voltage selection and modulation circuit 632 selects the control signals s0 and s8 of the analog switches ASW0 and ASW8 corresponding to the reference gray-scale voltages V0 and V8 and modulates the signals s0 and s8 using the signal t4 and a signal $\overline{t4}$ obtained by inverting the signal t4. In other words, the control signal s0 has the same waveform as the signal t4, and the control signal s8 has a waveform obtained by inverting the waveform of the signal t4.

Accordingly, the 6-bit driving device 600 outputs a signal having a waveform shown in FIG. 24. Based on the above-described principle, the pixels are supplied with a DC voltage which is an average voltage of the oscillation voltages.

In this manner, seven interpolation gray-scale voltages are formed between the nine reference gray-scale voltages. As a result, 64-gray-scale display is realized by the 6-bit driving device 600.

However, in the state where the output circuits close to each other output oscillating voltages (interpolation gray-scale voltage) which are formed by a pair of adjacent reference gray-scale voltages, the voltage to be supplied to the pixels changes as in the case of a 3-bit driving device. As a result, accurate gray-scale levels are not obtained.

FIG. 25 shows waveforms of an interpolation gray-scale voltage V5 between the reference gray-scale voltages V0 and V8 and an interpolation gray-scale voltage V11 between the reference gray-scale voltages V8 and V16. In this case, a voltage drop occurs in a voltage supply line for supplying the reference gray-scale voltage V0 by the current Iv0 which flows to the load. However, a normal voltage rise for compensating for such a voltage drop does not occur in a voltage supply line for supplying the reference gray-scale voltage V8 by the influence of a current Iv8' for generating the interpolation gray-scale voltage V11 which flows to the load. As a result, the interpolation gray-scale voltage V5 to be supplied to the pixels changes.

In a voltage supply line for supplying a reference gray-scale voltage V16, a voltage rise occurs; but in a voltage supply line for supplying the reference gray-scale voltage V8, a normal voltage drop does not occur. As a result, the interpolation gray-scale voltage V11 to be supplied to the pixels also changes.

A conventional 8-bit driving device will be described.

FIG. 26 shows a configuration of one output circuit 700*a* of an 8-bit driving device 700. The output circuit 700*a* corresponds to one source line (load), and includes a sampling circuit 710 for sampling data signals D0 through D7 forming 8-bit display data based on a sampling signal Tsmp, a holding circuit 720 for storing an output from the sampling circuit 710, and a selection control section 730 for controlling a plurality of analog switches ASW32*i* (i=0, 1 . . . 8) based on memory data d0 through d5 in the holding circuit 720.

FIG. 27 shows a configuration of the selection control section 730. The selection control section 730 includes a switch section 730*b* having the plurality of analog switches ASW32*i*, and a selection control circuit 730*a* for controlling the analog switches ASW32*i* based on the memory data d0 through d7 in the holding circuit 720. Reference gray-scale voltages V32*i* (i=0, 1, . . . 8) are supplied to the switch section 730*b* from outside the 8-bit driving device 700 and output to the load through the respective analog switches ASW32*i*.

FIG. 28 shows a detailed configuration of the selection control circuit 730*a*. As is shown in FIG. 28, the selection control circuit 730*a* includes an interpolation signal generation circuit 731 and a voltage selection and modulation circuit 732. The interpolation signal generation circuit 731 selects a prescribed signal among a plurality of signals having waveforms which have different duty ratios, based on the lower 5 bits d0 through d4 of the 8-bit display data.

Accordingly, the 8-bit driving device 700 outputs signals t0 through t4 having waveforms shown in FIG. 29.

Table 4A shows a logical configuration of the interpolation signal generation circuit 731, and Table 4B shows a logical configuration of the voltage selection and modulation circuit 732.

TABLE 4A

| d4 | d3 | d2 | d1 | d0 | T |
|---|---|---|---|---|---|
| * | * | * | * | 1 | τ0 |
| * | * | * | 1 | * | τ1 |
| * | * | 1 | * | * | τ2 |
| * | 1 | * | * | * | τ3 |
| 1 | * | * | * | * | τ4 |

Symbol * indicates that the memory data and the signal are not related to each other.

TABLE 4B

| d7 | d6 | d5 | S0 | S32 | S64 | S96 | S128 | S160 | S192 | S224 | S256 |
|---|---|---|---|---|---|---|---|---|---|---|---|
| 0 | 0 | 0 | $\bar{T}$ | T | | | | | | | |
| 0 | 0 | 1 | | $\bar{T}$ | T | | | | | | |
| 0 | 1 | 0 | | | $\bar{T}$ | T | | | | | |
| 0 | 1 | 1 | | | | $\bar{T}$ | T | | | | |
| 1 | 0 | 0 | | | | | $\bar{T}$ | T | | | |
| 1 | 0 | 1 | | | | | | $\bar{T}$ | T | | |
| 1 | 1 | 0 | | | | | | | $\bar{T}$ | T | |
| 1 | 1 | 1 | | | | | | | | $\bar{T}$ | T |

The interpolation signal T from the interpolation signal generation circuit 731 is expressed by:

$$T=d0\tau0+d1\tau1+d2\tau2+d3\tau3+d4\tau4.$$

In this manner, 31 interpolation gray-scale voltages are formed between the nine reference gray-scale voltages. As a result, 256-gray-scale display is realized by the 8-bit driving device 700. Such an 8-bit driving device is proposed in Japanese Patent Application No. 5-297103.

However, the voltage to be supplied to the pixels changes for the same reason as described regarding the 3-bit driving device 500 and the 6-bit driving device 600.

In the case of 256-gray-scale display, the difference between voltages corresponding to two adjacent gray-scale levels is very small, and thus gray-scale inversion occurs by even a very slight change in the voltage.

For example, if a voltage corresponding to 256 gray-scale levels is equally divided within 5 volts, the voltage difference between two adjacent gray-scale levels is only approximately 20 mV. This is ¼ the voltage difference of a 64-gray-scale display. If the voltage changes by 30 mV in the output circuit, no gray-scale inversion occurs in a 6-bit driving device, but gray-scale inversion occurs in an 8-bit driving device. Such an 8-bit driving device cannot be used for 256-gray-scale display. In practice, the voltage vs. transmittance curve of the liquid crystal material is nonlinear. Accordingly, the difference between voltages corresponding to two adjacent gray-scale levels in 256-gray-scale display is approximately 5 mV in an intermediate area of the gray scale between the highest gray-scale level and the lowest gray-scale level, which is much smaller than 20 mV. For 256-gray-scale display, a voltage change needs to be restricted to such extreme precision.

In the above-described conventional driving devices, interpolation gray-scale voltages are formed using reference gray-scale voltages supplied from outside the devices and a voltage corresponding to the display data is supplied to the load. For example, the interpolation gray-scale voltages are formed using adjacent three reference gray-scale voltages and supplied to the pixels. In a voltage supply line for supplying the intermediate reference gray-scale voltage, a voltage drop or a voltage rise which needs to occur is prevented due to the influence of the currents flowing to the load which is provided with the interpolation voltages interposing the intermediate reference gray-scale voltage. As a result, crosstalk occurs, and thus accurate reproduction of the display data is not realized.

SUMMARY OF THE INVENTION

In one aspect of the present invention, a driving circuit used in a display apparatus includes a plurality of output circuits for selecting two reference gray-scale voltages among a plurality of different reference gray-scale voltages based on display data and outputting an interpolation voltage corresponding to the display data using the two reference gray-scale voltages; and a plurality of supply lines for supplying the plurality of reference gray-scale voltages. The supply lines includes a plurality of voltage supply lines and a plurality of signal supply lines. One of the plurality of voltage supply lines supplies a voltage having a minimum difference from the voltage of a common electrode of the display apparatus, and another of the plurality of voltage supply lines supplies a voltage having a maximum difference from the voltage of the common electrode. The two reference gray-scale voltages selected by each of the output circuits are supplied by one of a plurality of pairs of supply lines. At least one of the pairs has a signal supply line and a supply line having a voltage higher than the signal supply line, and another of the pairs has a signal supply line and a supply line having a voltage lower than the signal supply line.

In one embodiment of the invention, the supply lines of each pair of supply lines have substantially an identical electric characteristic.

In one embodiment of the invention, two of the signal supply lines are electrically connected to each other to provide a path for currents flowing to and from a load in a steady state after a transition period.

In one embodiment of the invention, the plurality of output circuits each forms an interpolation gray-scale voltage by an oscillating voltage method.

In one embodiment of the invention, the plurality of output circuits each forms an interpolation gray-scale voltage by a resistance division method.

In another aspect of the present invention, a liquid crystal display apparatus for forming an image using a liquid crystal material includes a liquid crystal display panel including a plurality of loads; and a driving circuit for driving the plurality of loads by a gray-scale voltage based on display data. The driving circuit includes a plurality of output circuits for selecting two reference gray-scale voltages among a plurality of different reference gray-scale voltages based on display data and outputting an interpolation voltage corresponding to the display data using the two reference gray-scale voltages; and a plurality of supply lines for supplying the plurality of reference gray-scale voltages. The supply lines including a plurality of voltage supply lines and a plurality of signal supply lines. One of the plurality of voltage supply lines supplies a voltage having a minimum difference from the voltage of a common electrode of the display apparatus and another of the plurality of voltage supply lines supplies a voltage having a maximum difference from the voltage of the common electrode. The two reference gray-scale voltages selected by each of the output circuits are supplied by one of a plurality of pairs of supply lines. At least one of the pairs has a signal supply line and a supply line having a voltage higher than the signal supply line, and another of the pairs has a signal supply line and a supply line having a voltage lower than the signal supply line.

Thus, the invention described herein makes possible the advantages of providing a driving circuit used in a display apparatus and a liquid crystal display apparatus using such a driving circuit for compensating for a crosstalk occurring between terminals when different interpolation signals are output, thus to display accurate gray-scale levels in accordance with the display data.

These and other advantages of the present invention will become apparent to those skilled in the art upon reading and understanding the following detailed description with reference to the accompanying figures.

DETAILED DESCRIPTION OF THE PREFERRED EMBODIMENTS

According to the present invention, in a digital driving device for forming an interpolation gray-scale voltage between reference gray-scale voltages which are supplied from outside the driving device, crosstalk which occurs between different output terminals when different interpolation gray-scale voltages are output from different output terminals is prevented. Thus, an image having an accurate gray-scale level in accordance with the display data is formed. For designing such a driving device, a known designing technology for arranging voltage supply lines for supplying reference gray-scale voltages and a known designing technology for configurating output circuits are used.

In order to obtain the above-described effect, voltage supply lines each include a first signal supply line and a second signal supply line, except for a voltage supply line for supplying a reference gray-scale voltage having the minimum difference from the common voltage in the liquid crystal display panel driven by the driving device and a voltage supply line for supplying a reference gray-scale voltage having the maximum difference from the common voltage in the liquid crystal display panel. In this specification, the phrase "supply line" means both of a voltage supply line and a signal supply line.

EXAMPLE 1

A 3-bit driving device used in a display apparatus in a first example according to the present invention will be described with reference to FIGS. 1 and 2.

Figure 1:
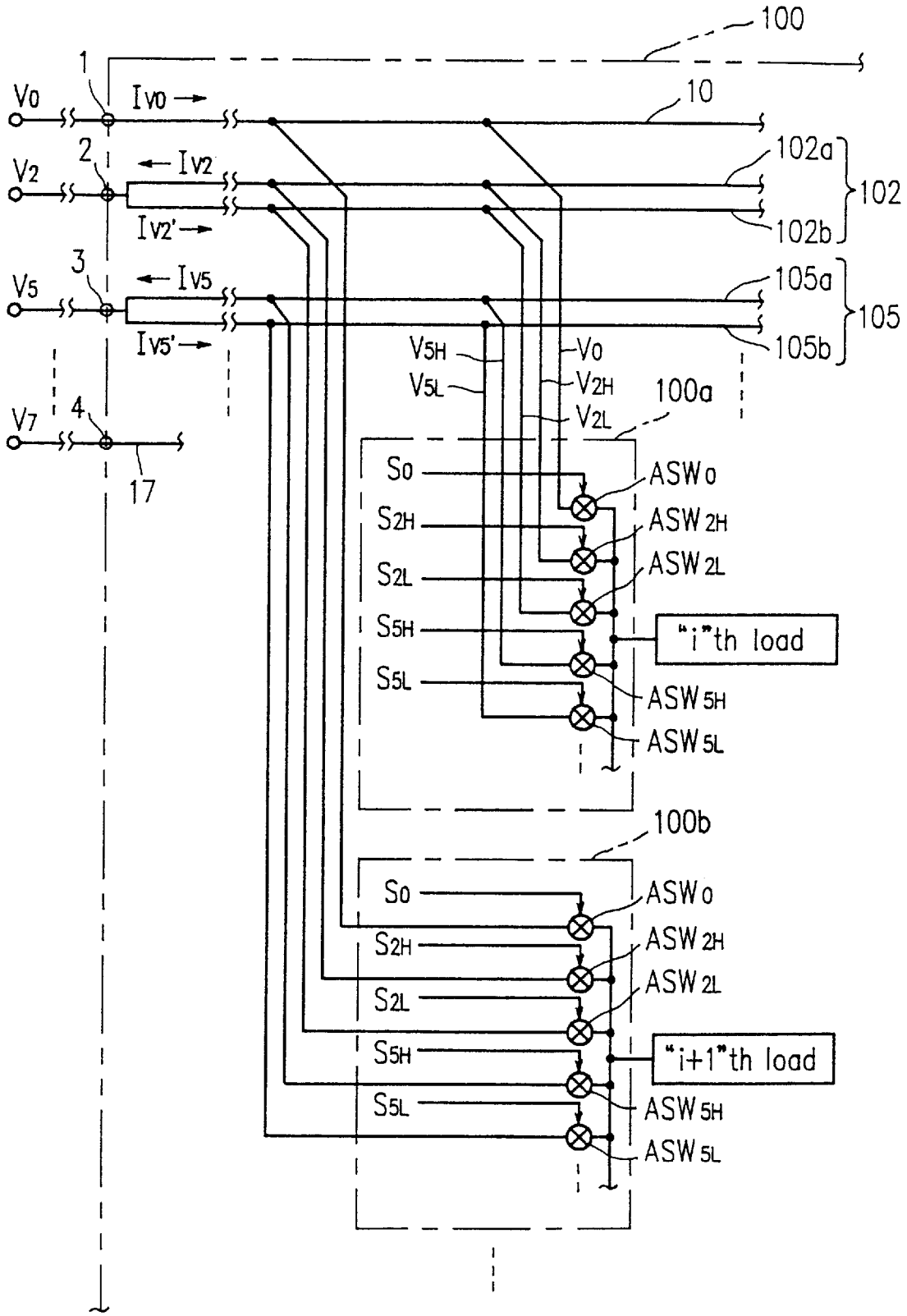
FIG. 1 is a diagram illustrating a part of a 3-bit driving device in a first example according to the present invention.
Figure 2:
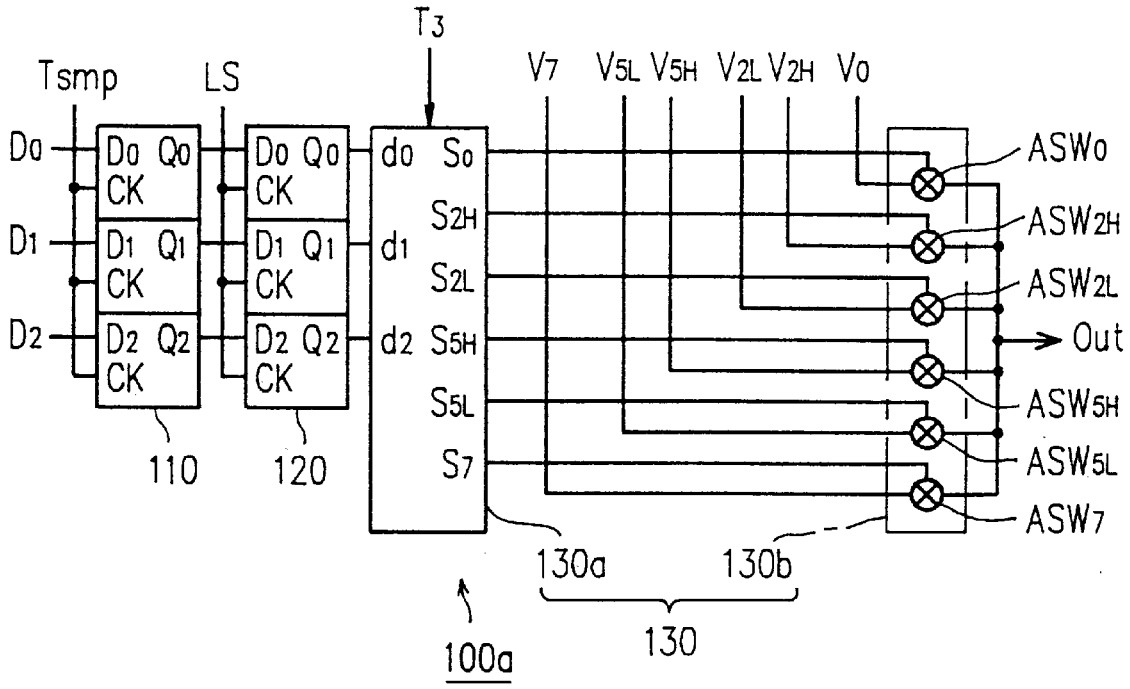
FIG. 2 is a diagram illustrating one of a plurality of output circuits of the 3-bit driving device shown in FIG. 1.
Figure 13:
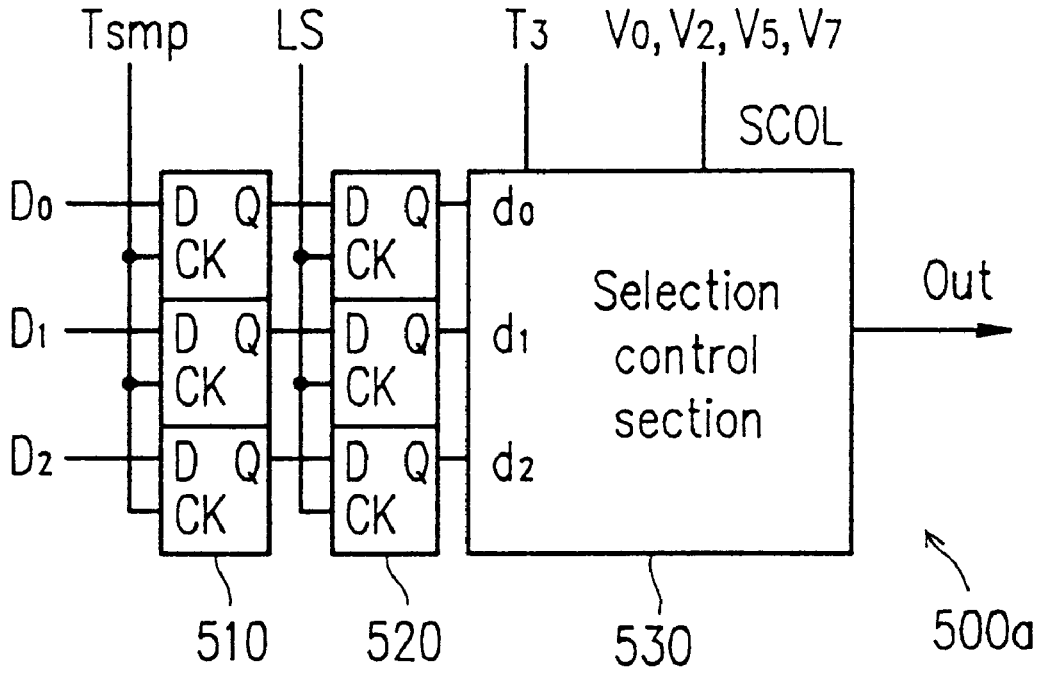
FIG. 13 is a diagram illustrating one of a plurality of output circuits of a conventional 3-bit driving device.
Figure 14:
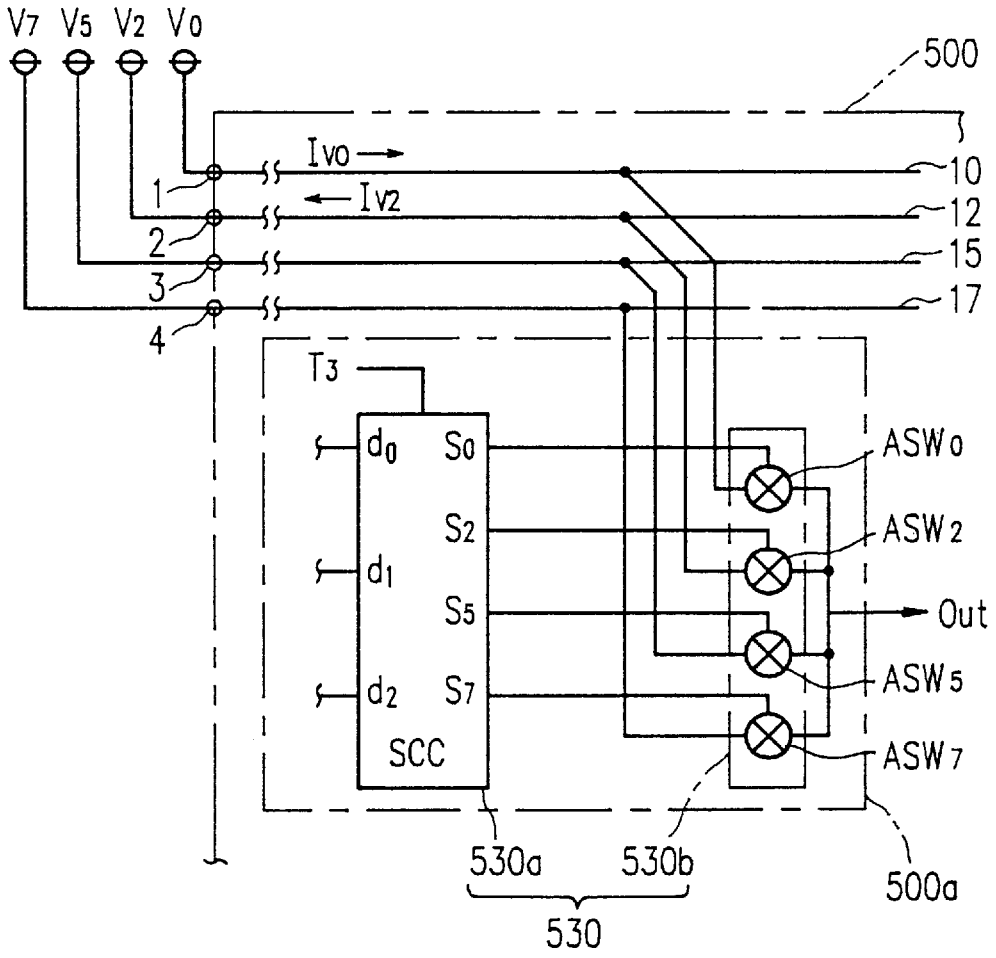
FIG. 14 is a diagram illustrating the conventional 3-bit driving device including the output circuit shown in FIG. 13.

FIG. 1 shows a partial configuration of a 3-bit driving device 100 configured as an LSI in the first example, and FIG. 2 shows a configuration of one output circuit in the 3-bit driving device 100. The 3-bit driving device 100 drives a liquid crystal display panel using the oscillating voltage method. The 3-bit driving device 100 is realized by applying the present invention to the conventional 3-bit driving device 500 shown in FIGS. 13 and 14. In FIGS. 1 and 2, the identical elements with those in the conventional 3-bit driving device 500 bear the same reference numerals therewith.

The 3-bit driving device 100 includes a plurality of output circuits 100*a*, 100*b*, . . . , each corresponding to one source line (load). The 3-bit driving device 100 includes voltage supply lines 10, 102, 105 and 17 respectively for supplying reference gray-scale voltages V0, V2, V5 and V7 supplied from outside the 3-bit driving device 100. The voltage supply lines 10, 102, 105 and 17 are respectively connected to input terminals 1, 2, 3 and 4 at one end thereof. The input terminals 1, 2, 3 and 4 are provided at an end of the 3-bit driving device 100.

Among the four voltage supply lines 10, 102, 105 and 17, the reference gray-scale voltage V0 supplied by the voltage supply line 10 has the minimum difference from the counter voltage of the liquid crystal display panel, and the reference gray-scale voltage V17 supplied by the voltage supply line 17 has the maximum difference from the counter voltage of the liquid crystal display panel. The other voltage supply lines 102 and 105 each include a pair of signal supply lines (first and second signal supply lines). The voltage supply line 102 includes signal supply lines 102*a* and 102*b*, which are connected to each other only at the input terminal 2. The voltage supply line 105 includes signal supply lines 105*a* and 105*b*, which are connected to each other only at the input terminal 3. In an alternative configuration, the signal supply lines 102*a* and 102*b* and the signal supply lines 105*a* and 105*b* are connected to each other in a container such as a TCP (tape carrier package) containing the 3-bit driving device 100 or outside such a container, instead of at the input terminals.

The output circuit 100*a* corresponds to the "i"th load, and the output circuit 100*b* corresponds to the "i+1"th load. The output circuits each send a gray-scale voltage based on data signals D0, D1 and D2 to the corresponding source line (load).

With reference to FIG. 2, the output circuit 100*a* will be described.

The output circuit 100*a* includes a sampling circuit 110 for sampling data signals D0, D1 and D2 based on a control signal Tsmp, a holding circuit 120 for storing an output from the sampling circuit 110 using a control signal LS, and a selection control section 130 for outputting a gray-scale voltage having a prescribed level to the source line based on memory data d0, d1 and d2 stored in the holding circuit 120.

The selection control section 130 includes a switch section 130*b* for switching a plurality of analog signals ASW0, ASW2H, ASW2L, ASW5H, ASW5L and ASW7, and a selection control circuit 130*a* for controlling such switching based on the memory data d0, d1 and d2 to select prescribed two reference gray-scale voltages among the four reference gray-scale voltages.

Figure 15:
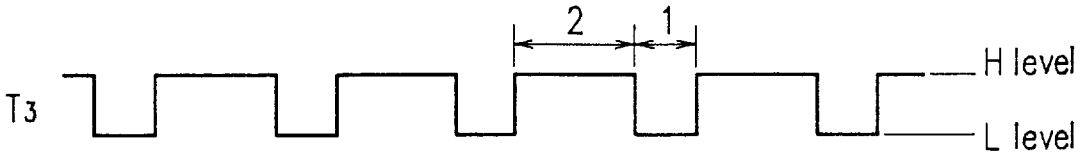
FIG. 15 is a waveform diagram of a pulse having a duty ratio of 2:1 used for forming an interpolation gray-scale voltage.
Figure 16:
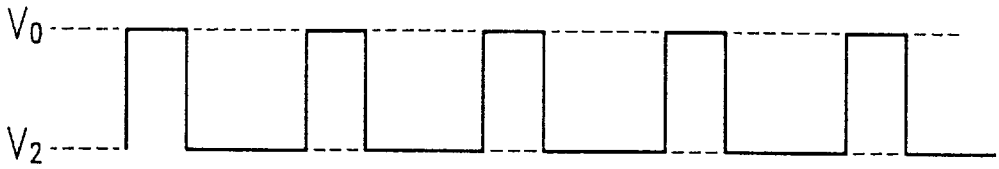
FIG. 16 is a waveform diagram illustrating waveforms of interpolation gray-scale voltages output from the conventional 3-bit driving device shown in FIG. 14.
Figure 16:
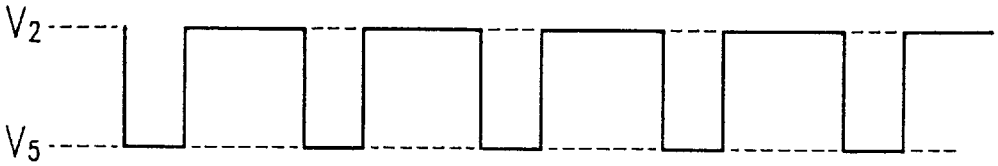
Figure 16:
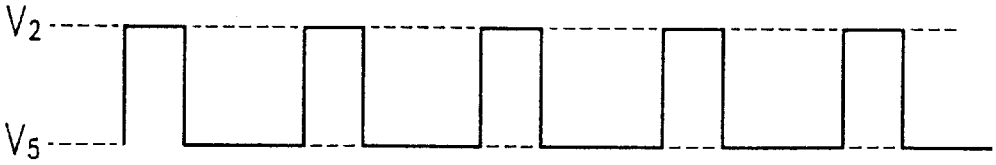
Figure 16:
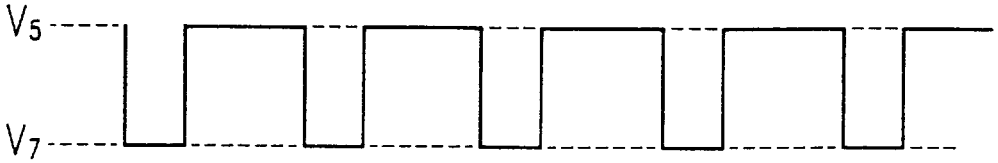
Figure 17:
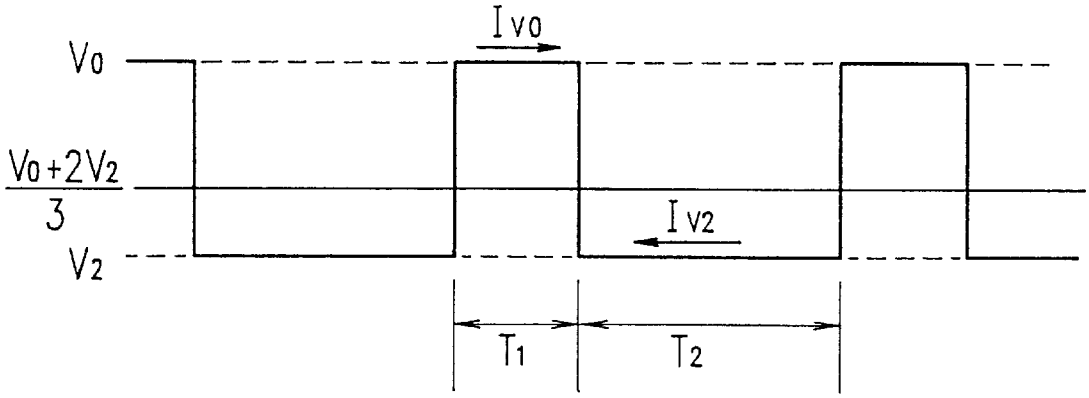
FIG. 17 is a waveform diagram illustrating one of the waveforms shown in FIG. 16 in detail.
Figure 18:
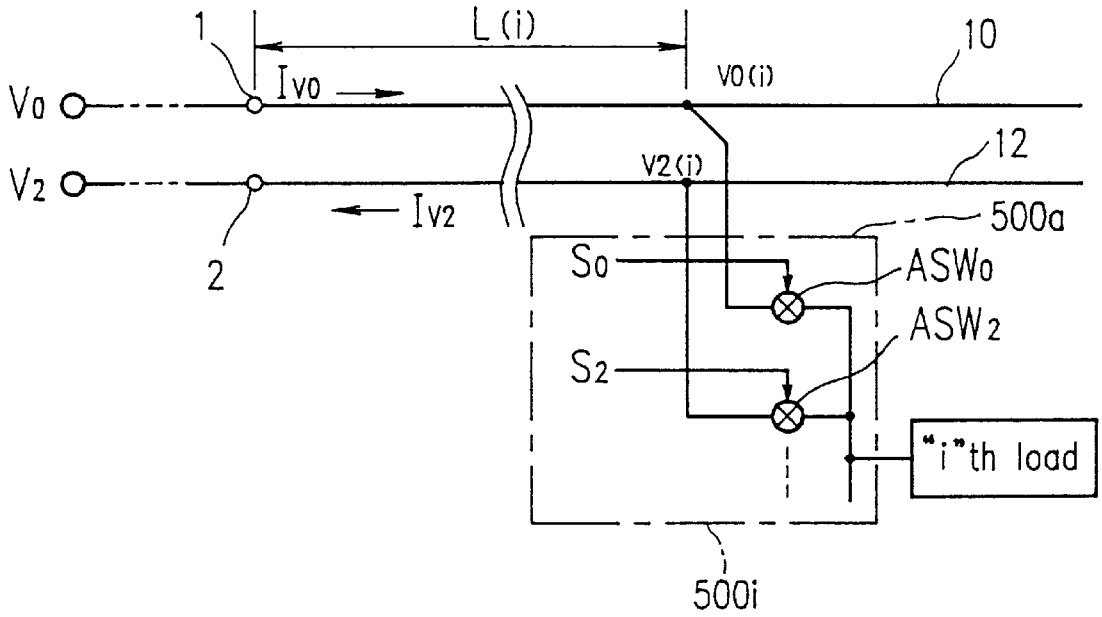
FIG. 18 is a diagram illustrating a path for a current from input terminals to an output terminal of the conventional 3-bit driving device.
Figure 19:
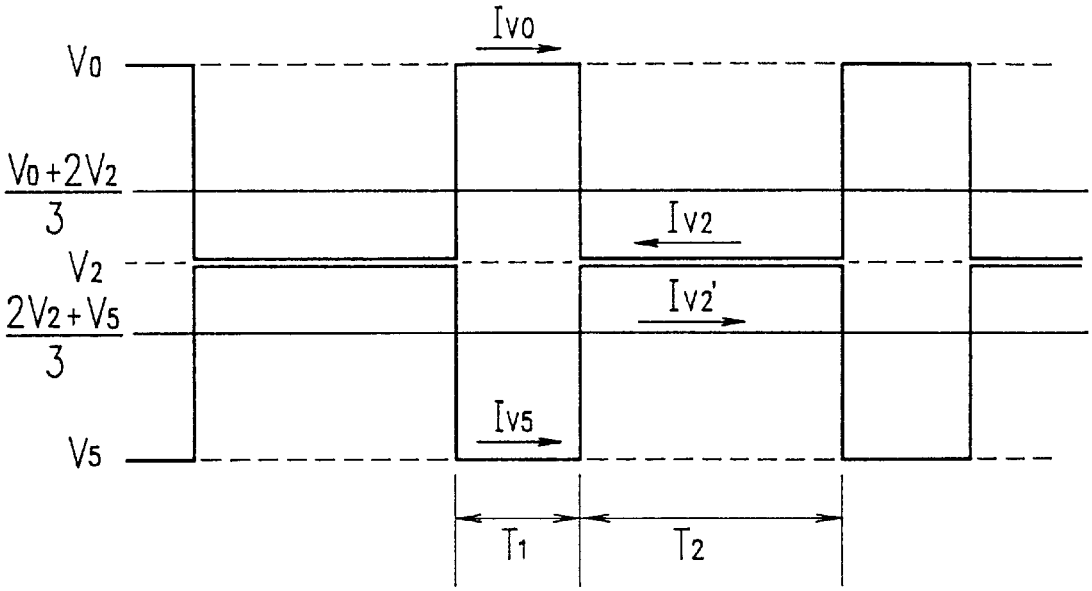
FIG. 19 is waveform diagram illustrating waveforms of interpolation voltages formed when the values of display data are 1 and 3 in the conventional 3-bit driving device.
Figure 20A:
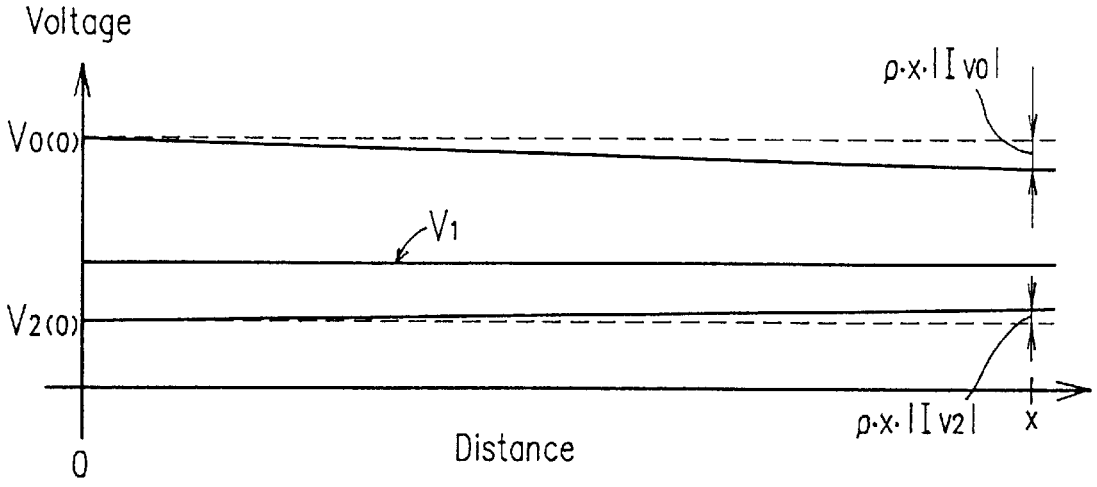
FIGS. 20A and 20B are graphs illustrating a voltage drop and a voltage rise caused in the conventional 3-bit driving device.
Figure 20B:
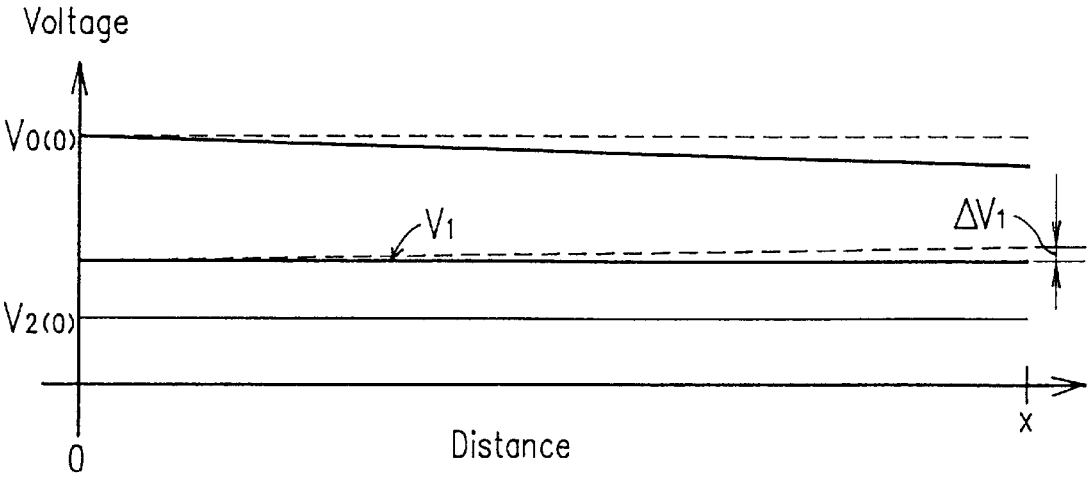

In detail, the analog switch ASW0 is connected to the voltage supply line 10, and the analog switch ASW7 is connected to the voltage supply line 17. The analog switches ASW2H and ASW2L are connected to the signal supply lines 102*a* and 102*b*, respectively. The analog switches ASW5H and ASW5L are connected to the signal supply lines 105*a* and 105*b*, respectively. The selection control circuit 130*a* selects two prescribed analog switches based on the memory data d0, d1 and d2 and turn "ON" or "OFF" the selected analog switches complementarily using a signal T3 having a duty ratio of 2:1 as is shown in FIG. 15. The above-mentioned selection is performed so as to always combine each of the signal supply lines 102*a* and 105*a* with a supply line having a higher voltage than the voltage thereof and to combine each of the signal supply lines 102*b* and 105*b* with a supply line having a lower voltage than the voltage thereof.

For example, an oscillating voltage (interpolation gray-scale voltage) is formed either by combining the reference gray-scale voltage V0 of the signal supply line 10 and the reference gray-scale voltage V2H of the signal supply line 102*a*, by combining the reference gray-scale voltage V2L of the signal supply line 102*b* and the reference gray-scale voltage V5H of the signal supply line 105*a*, or by combining the reference gray-scale voltage V5L of the signal supply line 105*b* and the reference gray-scale voltage V17 of the signal supply line 17. All the signal supply lines and the voltage supply lines 10 and 17 preferably have as much of the same signal transmission characteristic as possible.

Table 5 shows a logic configuration of the selection control circuit 130*a*, namely, the relationship between input and output.

TABLE 5

| d2 | d1 | d0 | S0 | S2H | S2L | S5H | S5L | S7 |
|---|---|---|---|---|---|---|---|---|
| 0 | 0 | 0 | $\overline{1}$ | | | | | |
| 0 | 0 | 1 | $\overline{\tau 3}$ | $\tau 3$ | | | | |
| 0 | 1 | 0 | | | 1 | | | |
| 0 | 1 | 1 | | | $\tau 3$ | $\overline{\tau 3}$ | | |
| 1 | 0 | 0 | | | $\overline{\tau 3}$ | $\tau 3$ | | |
| 1 | 0 | 1 | | | | | 1 | |
| 1 | 1 | 0 | | | | | $\tau 3$ | $\overline{\tau 3}$ |
| 1 | 1 | 1 | | | | | | 1 |

From Table 5, the following logical expression is obtained. The selection control circuit 130*a* is realized by using such a logical expression for a logic circuit.

$$\begin{cases} s_0 = \{0\} + \{1\}\overline{\tau}_3 \\ s_{2H} = \{1\}\tau_3 \\ s_{2L} = \{2\} + \{3\}\tau_3 + \{4\}\overline{\tau}_3 \\ s_{5H} = \{3\}\overline{\tau}_3 + \{4\}\tau_3 \\ s_{5L} = \{5\} + \{6\}\tau_3 \\ s_7 = \{6\}\overline{\tau}_3 + \{7\} \end{cases}$$

where n in {n} represents a decimal number indicated by the lower 3 bits.

That is,

{0} = 000 {1} = 001

{2} = 010 {3} = 011

{4} = 100 {5} = 101

{6} = 110 {7} = 111

The 3-bit driving device 100 having the above-described structure operates in the following manner.

For example, in the case when the reference gray-scale voltages V0 and V2 are selected in the output circuit 100*a* and the reference gray-scale voltages V2 and V5 are selected in the output circuit 100*b*, the operation of the 3-bit driving device 100 is as follows.

In the signal supply line 102*a*, a voltage rise occurs by a current Iv2 flowing from the load. At this point, a voltage drop occurs by a current Iv0 flowing to the load in the voltage supply line 10 for supplying the reference gray-scale voltage V0, which is the highest among the four reference gray-scale voltages V0, V2, V5 and V7. The voltage rise in the signal supply line 102*a* and the voltage drop in the voltage supply line 10 compensate for each other, and thus an accurate and uniform interpolation gray-scale voltage V1 is provided to the pixels connected to the respective source lines.

In the signal supply line 102*b*, a voltage drop occurs by a current Iv2' flowing to the load. At this point, a voltage rise occurs by a current Iv5 flowing from the load in the signal supply line 105*a*. The voltage drop in the signal supply line 102*b* and the voltage rise in the voltage supply line 105*a* compensate for each other, and thus an accurate and uniform interpolation gray-scale voltage V3 is provided to the pixels connected to the respective source lines.

Such compensation for a change in the voltage caused by a resistance between the voltage supply lines is also performed between the signal supply line 105*b* and the voltage supply line 17 in the same manner. Thus, an accurate and uniform interpolation gray-scale voltage is provided to the pixels connected to the respective source lines.

In the 3-bit driving device 100 in the first example, crosstalk which occurs between output terminals when different interpolation gray-scale voltages are output from different output terminals is prevented. Thus, each area of the image supplied with the same display data exhibits the same gray-scale level.

EXAMPLE 2

A 6-bit driving device used in a display apparatus in a second example according to the present invention will be described with reference to FIGS. 3, 4 and 5.

Figure 3:
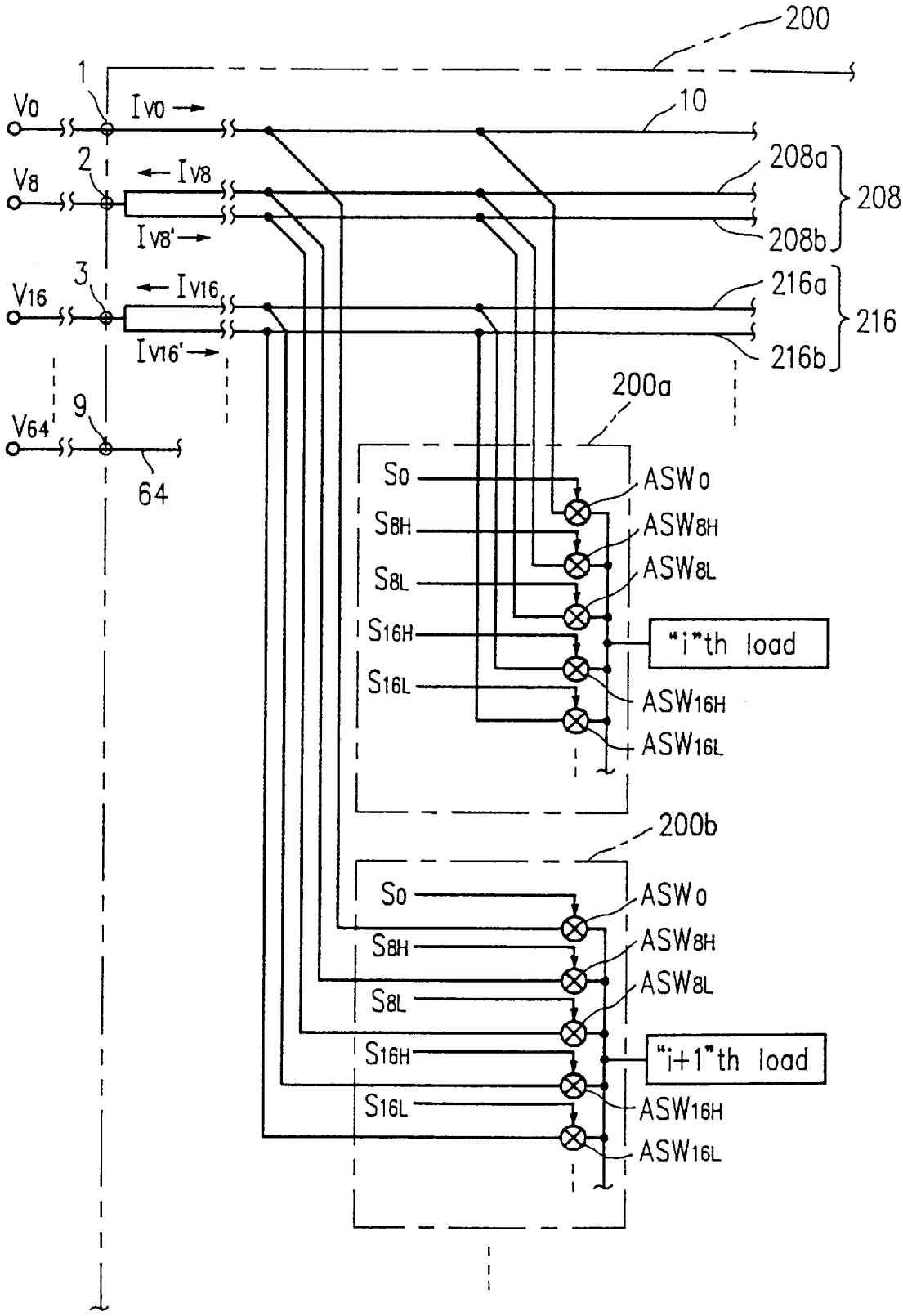
FIG. 3 is a diagram illustrating a part of a 6-bit driving device in a second example according to the present invention.
Figure 4:
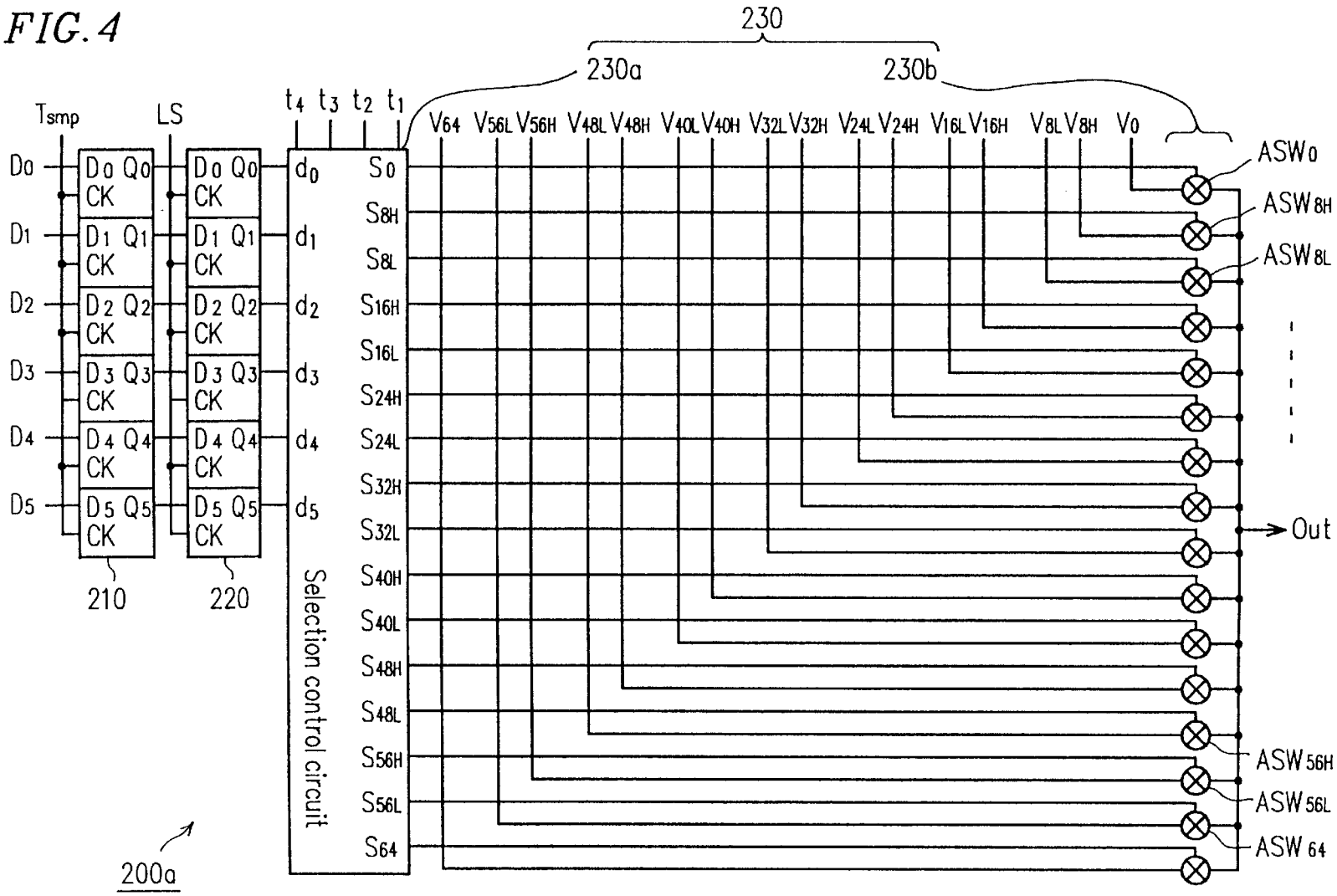
FIG. 4 is a diagram illustrating one of a plurality of output circuits of the 6-bit driving device shown in FIG. 3.
Figure 21:
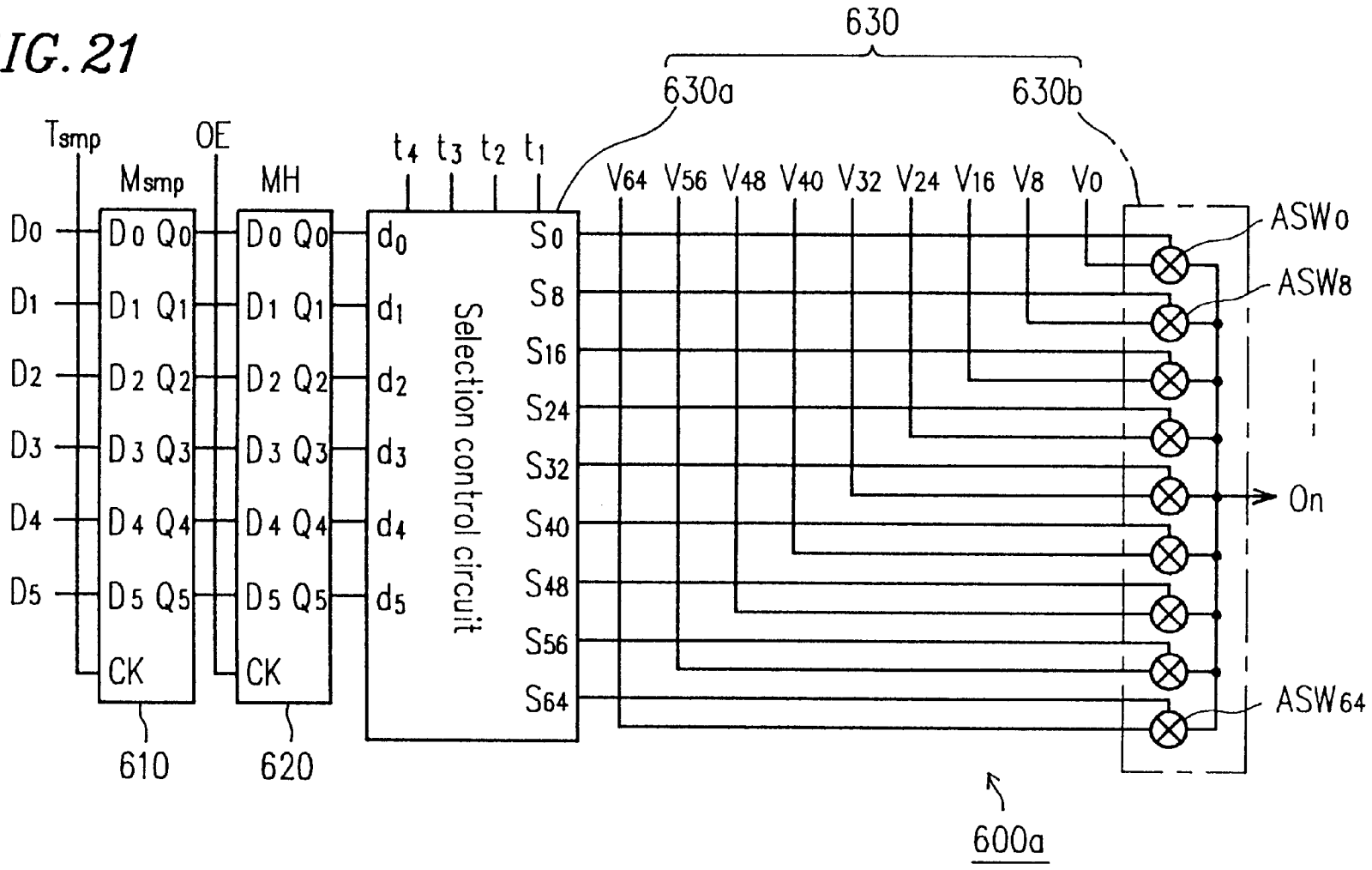
FIG. 21 is a diagram illustrating one of a plurality of output circuits of a conventional 6-bit driving device.
Figure 22:
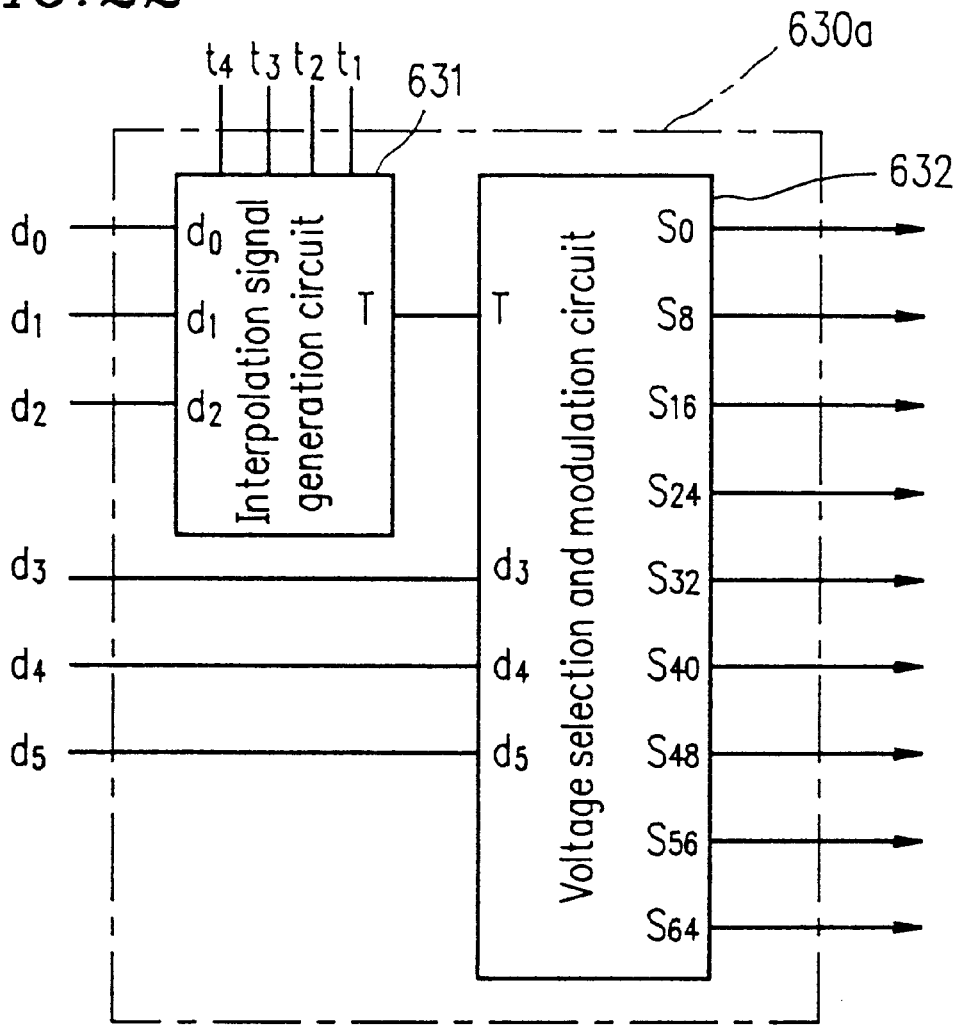
FIG. 22 is a diagram illustrating a selection control circuit in the output circuit shown in FIG. 21.
Figure 23:
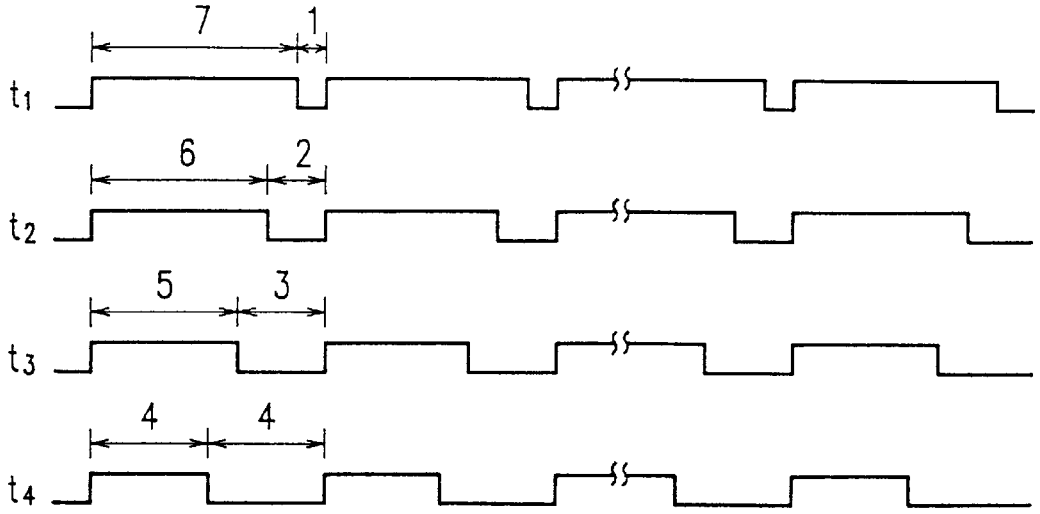
FIG. 23 is a waveform diagram illustrating waveforms of signals having different duty ratios which are input to the conventional 6-bit driving device.
Figure 24:
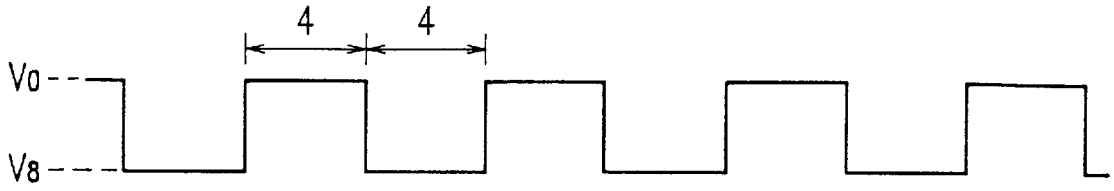
FIG. 24 is a waveform diagram illustrating waveforms of an interpolation gray-scale voltage output from the output circuit of the conventional 6-bit driving device.

FIG. 3 shows a configuration of a 6-bit driving device 200 configured as an LSI in the second example, and FIG. 4 shows a configuration of one output circuit in the 6-bit driving device 200. The 6-bit driving device 200 drives a liquid crystal display panel using the oscillating voltage method. The 6-bit driving device 200 is realized by applying the present invention to the conventional 6-bit driving device 600 shown in FIGS. 21 and 22. In FIGS. 3 through 5, the identical elements with those in the conventional 6-bit driving device 600 bear the same reference numerals therewith.

The 6-bit driving device 200 includes a plurality of output circuits 200*a*, 200*b*, . . . , each corresponding to one source line. The 6-bit driving device 200 includes nine voltage supply lines 10, 208, 216, . . . 256 and 64 respectively for supplying nine reference gray-scale voltages V8*i* (i=0, 1, 2, . . . 8) supplied from outside the 6-bit driving device 200. The nine voltage supply lines are respectively connected to input terminals 1 through 9 at one end thereof. The input terminals 1 through 9 are provided at an end of the 6-bit driving device 200.

Among the nine voltage supply lines, the reference gray-scale voltage V0 supplied by the voltage supply line 10 has the minimum difference from the counter voltage of the liquid crystal display panel, and the reference gray-scale voltage V64 supplied by the voltage supply line 64 has the maximum difference from the counter voltage of the liquid crystal display panel. The other voltage supply lines each include a pair of signal supply lines.

For example, the voltage supply line 208 for supplying a reference gray-scale voltage V8 includes signal supply lines 208*a* and 208*b*, which are connected to each other only at the input terminal 2. The voltage supply line 216 for supplying a reference gray-scale voltage V16 includes signal supply lines 216*a* and 216*b*, which are connected to each other only at the input terminal 3.

The output circuit 200*a* corresponds to the "i"th load, and the output circuit 200*b* corresponds to the "i+1"th load. The output circuits each send a gray-scale voltage based on data signals D0 through D5 to the corresponding source line.

With reference to FIG. 4, the output circuit 200*a* will be described.

The output circuit 200*a* includes a sampling circuit 210 for sampling data signals D0 through D5 based on a control signal Tsmp, a holding circuit 220 for storing an output from the sampling circuit 210 using a control signal LS, and a selection control section 230 for outputting a gray-scale voltage having a prescribed level to the source line based on memory data d0 through d5 stored in the holding circuit 220.

The selection control section 230 includes a switch section 230*b* for switching a plurality of analog switches ASW0, ASW8*i*H, ASW8*i*L (i=1, 2, . . . 7) and ASW64, and a selection control circuit 230*a* for controlling such switching based on the memory data d0 through d5 to select prescribed two reference gray-scale voltages among the nine reference gray-scale voltages.

In detail, the analog switch ASW0 is connected to the voltage supply line 10, and the analog switch ASW64 is connected to the voltage supply line 64. The analog switches ASW8H and ASW8L are connected to the signal supply lines 208*a* and 208*b*, respectively. The analog switches ASW16H and ASW16L are connected to the signal supply lines 216*a* and 216*b*, respectively. The other analog switches are connected to the signal supply lines in the same manner.

Figure 5:
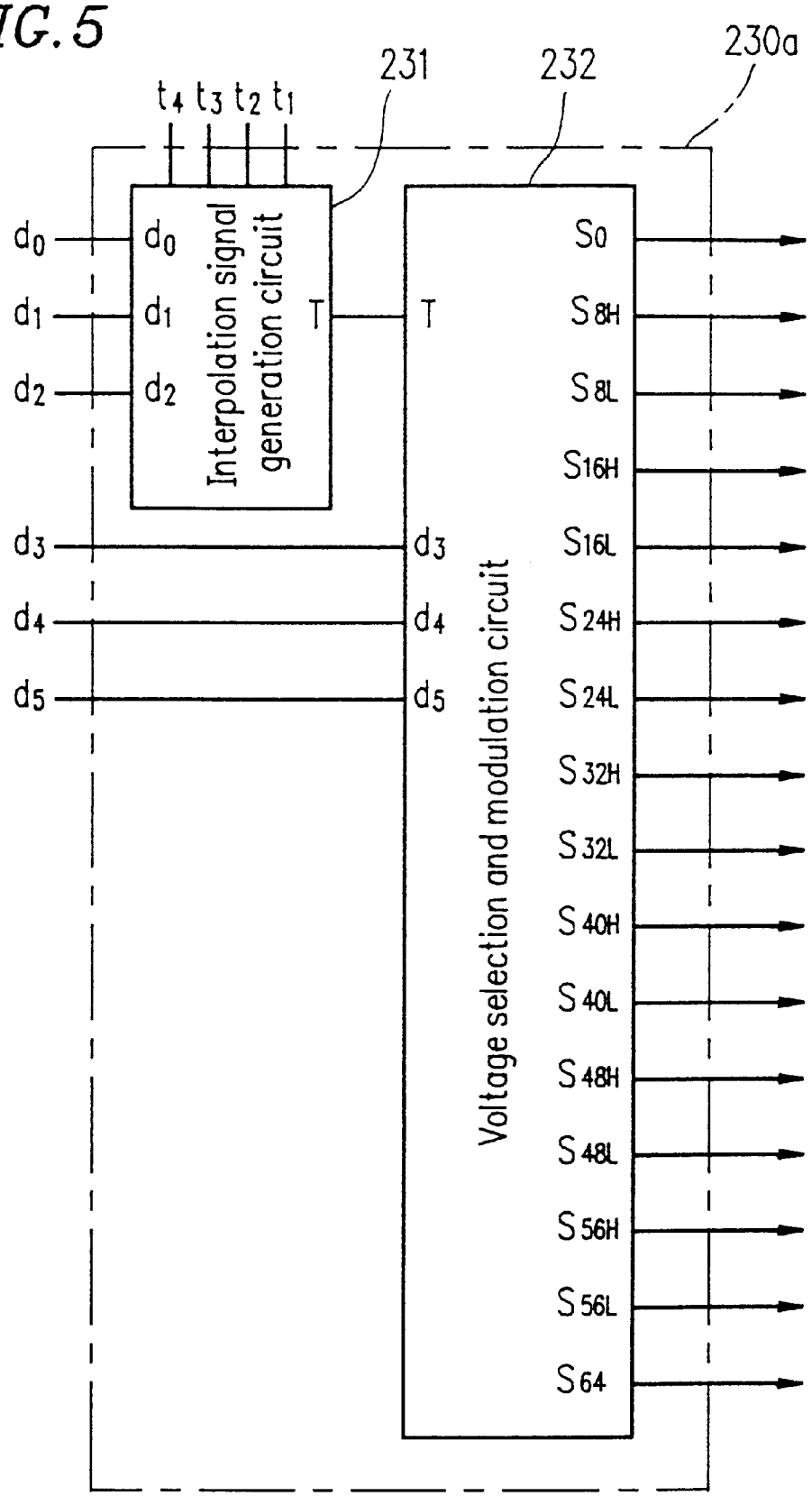
FIG. 5 is a diagram illustrating a selection control circuit in the output circuit shown in FIG. 4.

As is shown in FIG. 5, the selection control circuit 230*a* includes an interpolation signal generation circuit 231 and a voltage selection and modulation circuit 232. The interpolation signal generation circuit 231 has the same structure and logic configuration as that of the interpolation signal generation circuit 631 in the conventional 6-bit driving device 600 (FIG. 22 and Table 3A), and outputs an interpolation signal T. The selection control circuit 230*a* turns ON prescribed two analog switches based on control signals s0, s64, s8*i*H and s8*i*L (i=1, 2, . . . 7) to select the two prescribed reference gray-scale voltages and modulates the selected reference gray-scale voltages based on the interpolation signal T from the interpolation signal generation circuit 231. The voltage selection and modulation circuit 232 has a logic configuration shown in Table 6. As is appreciated from Table 6, the above-mentioned selection is performed so as to always combine, for example, each of the signal supply lines 208*a* with a supply line having a higher voltage than the voltage thereof and to combine, for example, each of the signal supply line 208*b* with a supply line having a lower voltage than the voltage thereof.

TABLE 6

| d5 | d4 | d3 | S0 | S8H | S8L | S16H | S16L | S24H | S24L | S32H | S32L | S40H | S40L | S48H | S48L | S56H | S56L | S64 |
|---|---|---|---|---|---|---|---|---|---|---|---|---|---|---|---|---|---|---|
| 0 | 0 | 0 | T | $\bar{T}$ | | | | | | | | | | | | | | |
| 0 | 0 | 1 | | | T | $\bar{T}$ | | | | | | | | | | | | |
| 0 | 1 | 0 | | | | | T | $\bar{T}$ | | | | | | | | | | |
| 0 | 1 | 1 | | | | | | | T | $\bar{T}$ | | | | | | | | |
| 1 | 0 | 0 | | | | | | | | | T | $\bar{T}$ | | | | | | |
| 1 | 0 | 1 | | | | | | | | | | | T | $\bar{T}$ | | | | |
| 1 | 1 | 0 | | | | | | | | | | | | | T | $\bar{T}$ | | |
| 1 | 1 | 1 | | | | | | | | | | | | | | | T | $\bar{T}$ |

From Table 6, the following logic expression is obtained. A logic circuit for the voltage selection and modulation circuit 232 is realized by applying such a logical expression to a logic circuit.

$$
\begin{aligned}
s_0 &= \{0\}T \\
s_{8H} &= \{0\}\overline{T} & s_{8L} &= \{8\}T \\
s_{16H} &= \{8\}\overline{T} & s_{16L} &= \{16\}T \\
s_{24H} &= \{16\}\overline{T} & s_{24L} &= \{24\}T \\
s_{32H} &= \{24\}\overline{T} & s_{32L} &= \{32\}T \\
s_{40H} &= \{32\}\overline{T} & s_{40L} &= \{40\}T \\
s_{48H} &= \{40\}\overline{T} & s_{48L} &= \{48\}T \\
s_{56H} &= \{48\}\overline{T} & s_{56L} &= \{56\}T \\
s_{64} &= \{56\}\overline{T}
\end{aligned}
$$

$$
\begin{aligned}
\text{where } \{0\} &= \overline{d}_5\overline{d}_4\overline{d}_3 & \{8\} &= \overline{d}_5\overline{d}_4 d_3 \\
\{16\} &= \overline{d}_5 d_4\overline{d}_3 & \{24\} &= \overline{d}_5 d_4 d_3 \\
\{32\} &= d_5\overline{d}_4\overline{d}_3 & \{40\} &= d_5\overline{d}_4 d_3 \\
\{48\} &= d_5 d_4\overline{d}_3 & \{56\} &= d_5 d_4 d_3
\end{aligned}
$$

The 6-bit driving device 200 having the above-described structure operates in the following manner.

For example, in the case when the reference gray-scale voltages V0 and V8 are selected in the output circuit 200*a* and the reference gray-scale voltages V8 and V16 are selected in the output circuit 200*b*, the operation of the 6-bit driving device 200 is as follows.

Figure 25:
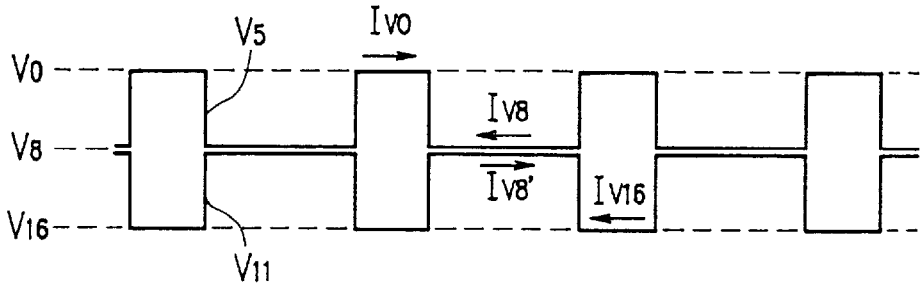
FIG. 25 is a waveform diagram illustrating waveforms of two interpolation gray-scale voltages formed using three reference gradation voltages by conventional 6-bit driving device.

A current Iv8 flowing from the load to the voltage supply line 208 for supplying the reference gray-scale voltage V8 shown in FIG. 25 flows through the signal supply line 208*a*, and causes a voltage rise therein. The voltage rise is compensated for by a voltage drop caused by the current Iv0 flowing to the load through the voltage supply line 10. Thus, uniform interpolation gray-scale voltages V1 through V7 are applied to the pixels connected to the respective source lines.

A current Iv8' flowing to the load from the voltage supply line 208 flows through the signal supply line 208*b*, and causes a voltage drop therein. The voltage drop is compensated for by a voltage rise caused by a current Iv16 flowing from the load through the signal supply line 216*a* of the voltage supply line 216. Thus, uniform interpolation gray-scale voltages V9 through V15 are applied to the pixels connected to the respective source lines.

EXAMPLE 3

An 8-bit driving device used in a display apparatus in a third example according to the present invention will be described with reference to FIGS. 6, 7 and 8.

Figure 6:
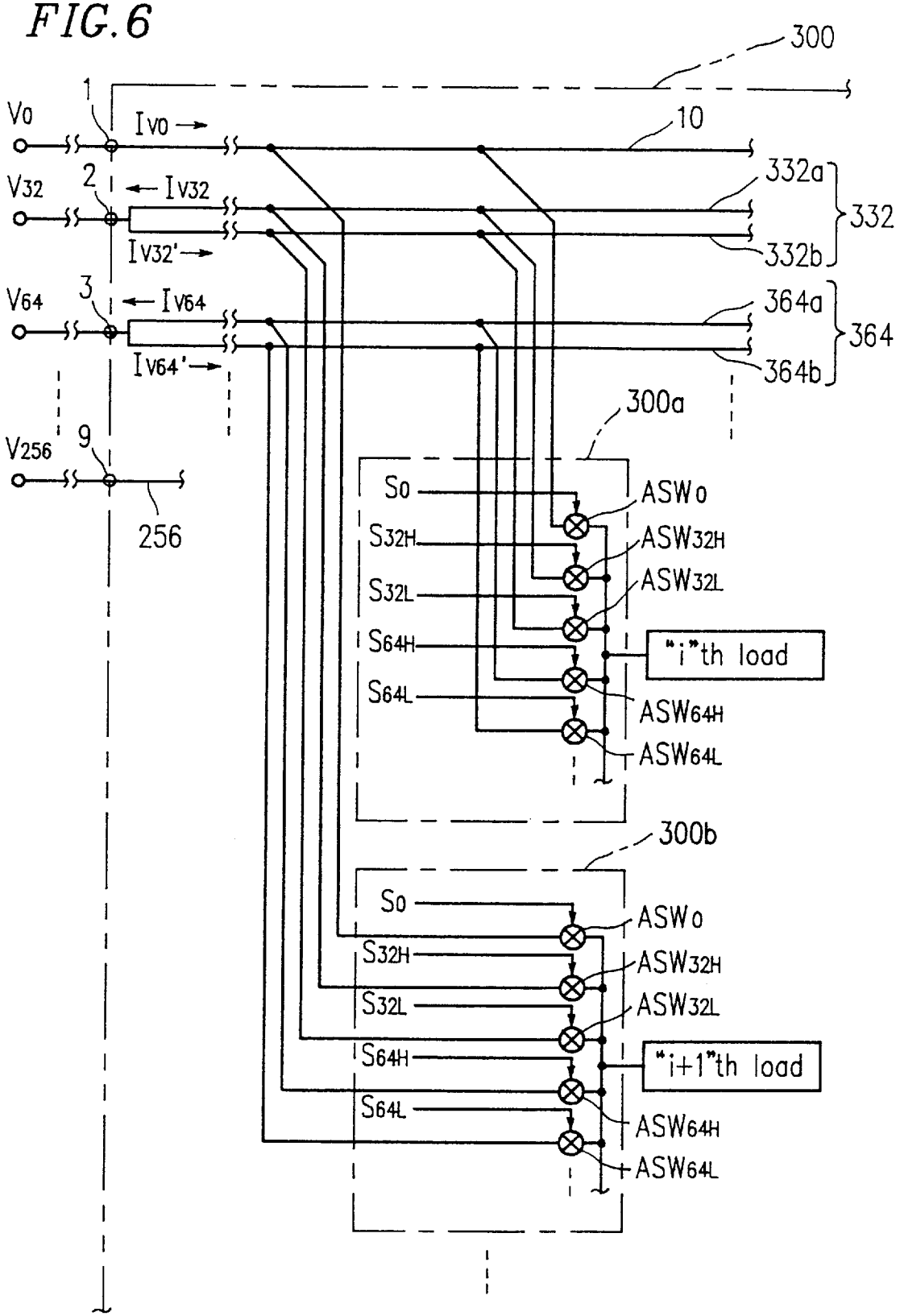
FIG. 6 is a diagram illustrating a part of an 8-bit driving device in a third example according to the present invention.
Figure 7:
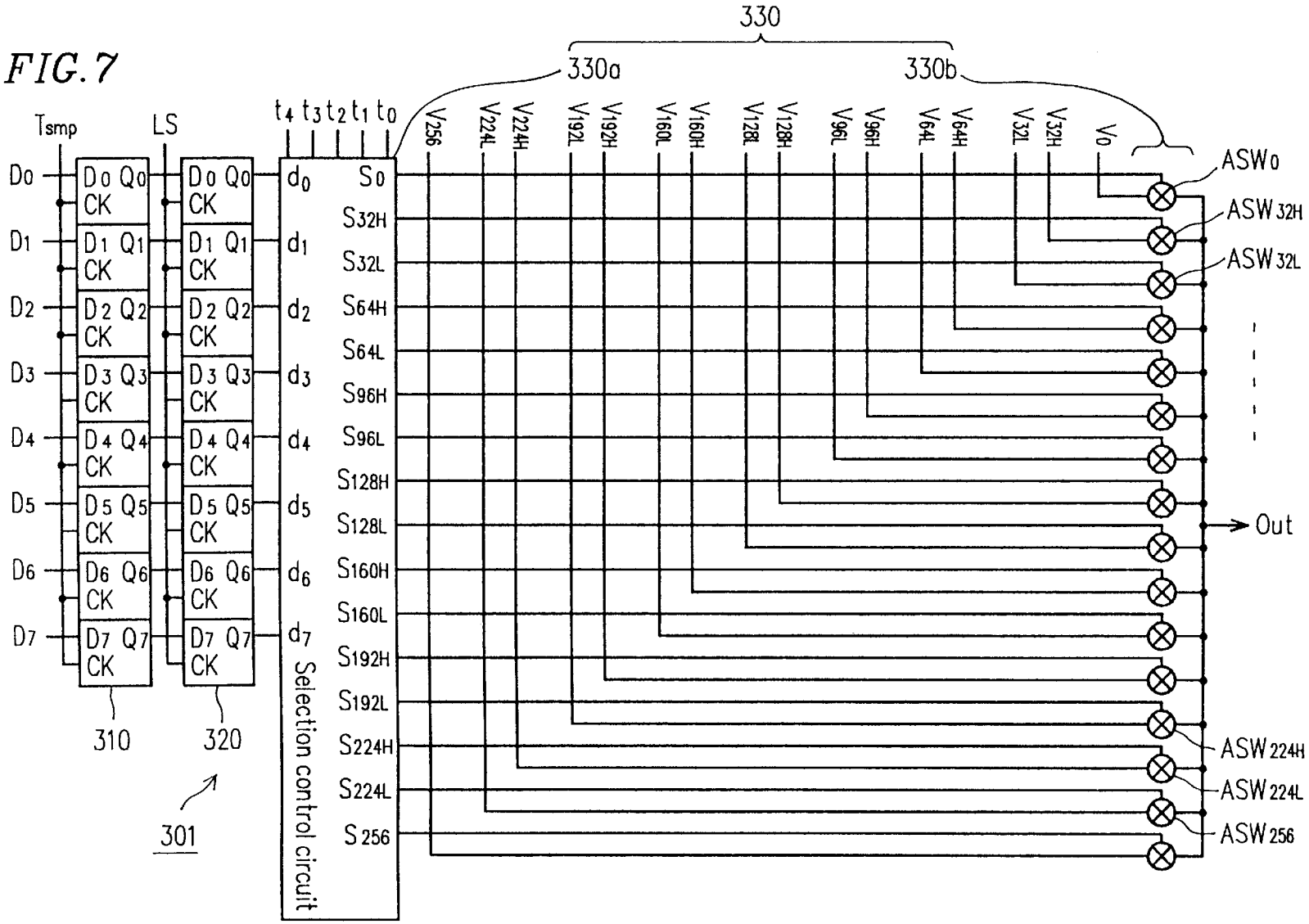
FIG. 7 is a diagram illustrating one of a plurality of output circuits of the 8-bit driving device shown in FIG. 6.
Figure 26:
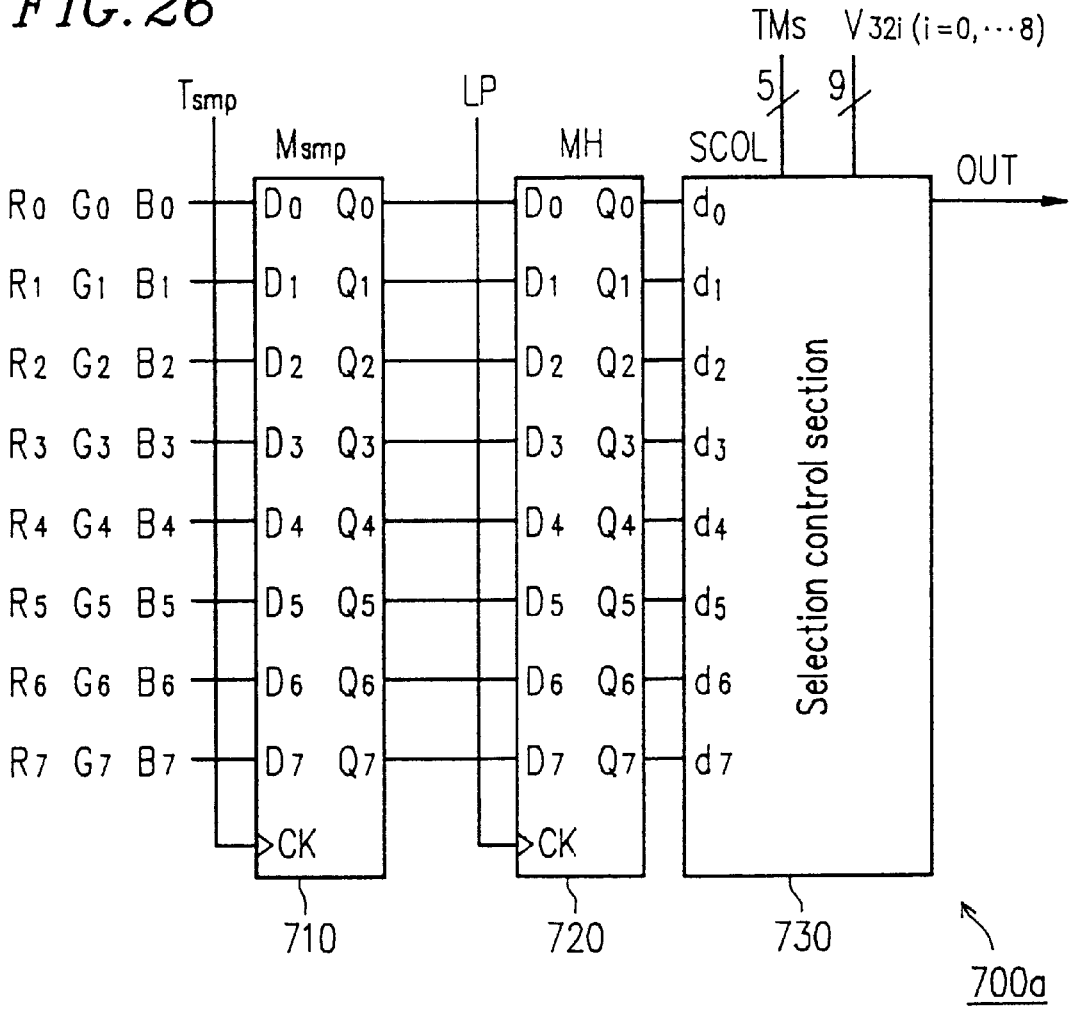
FIG. 26 is a diagram illustrating one of a plurality of output circuits of a conventional 8-bit driving device.
Figure 27:
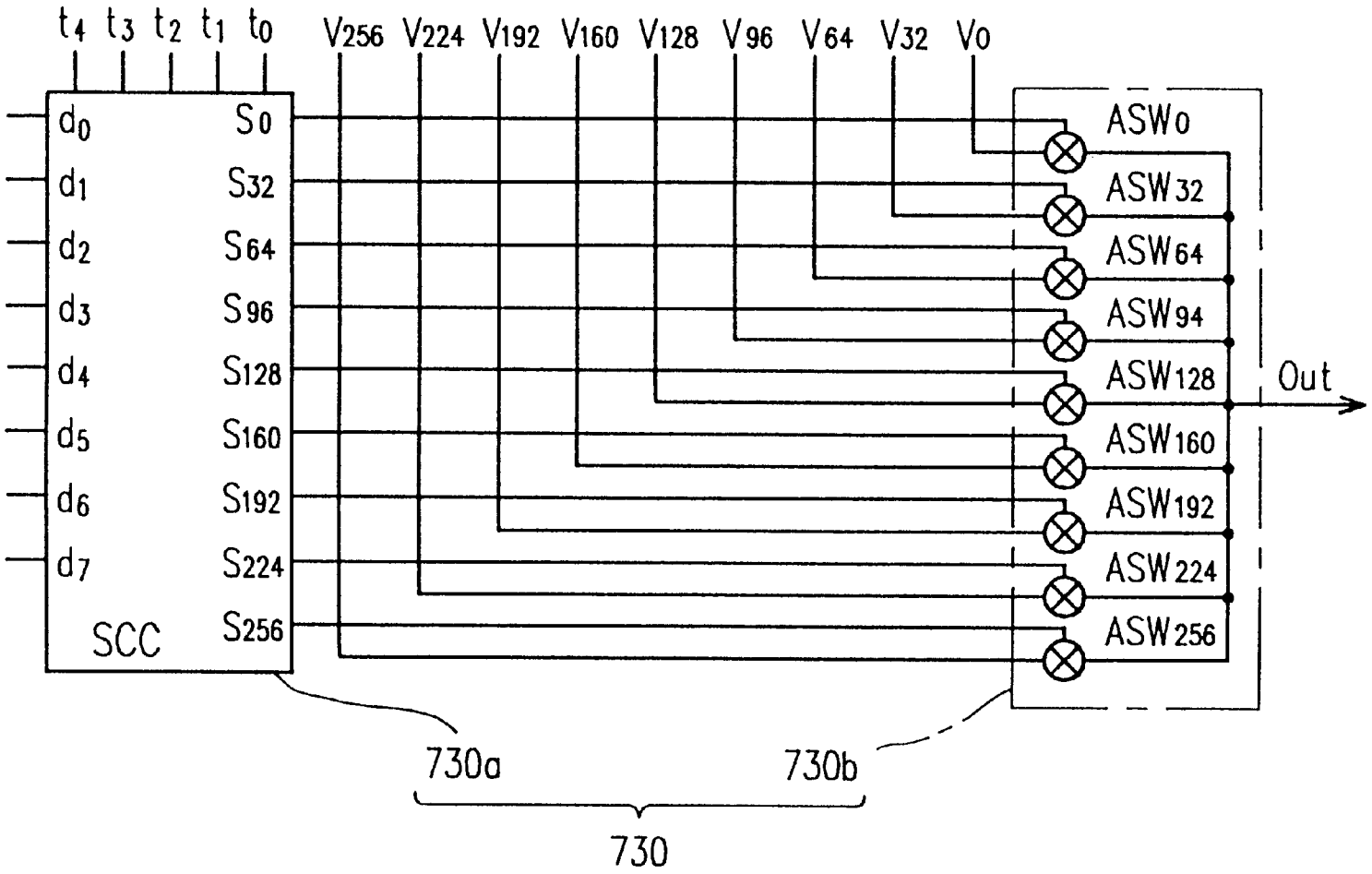
FIG. 27 is a diagram illustrating a selection control section of the output circuit shown in FIG. 26.
Figure 28:
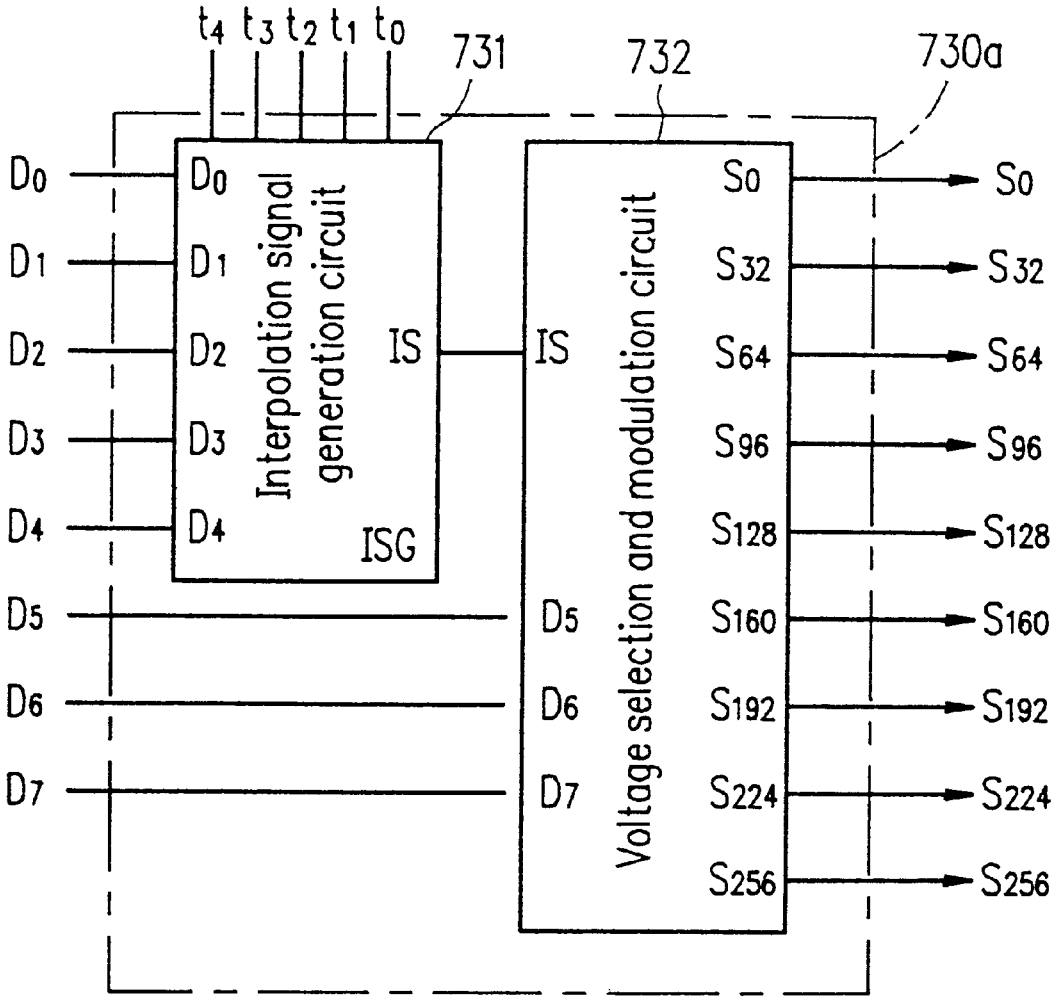
FIG. 28 is a diagram illustrating a selection control circuit in the selection control section shown in FIG. 27.
Figure 29:
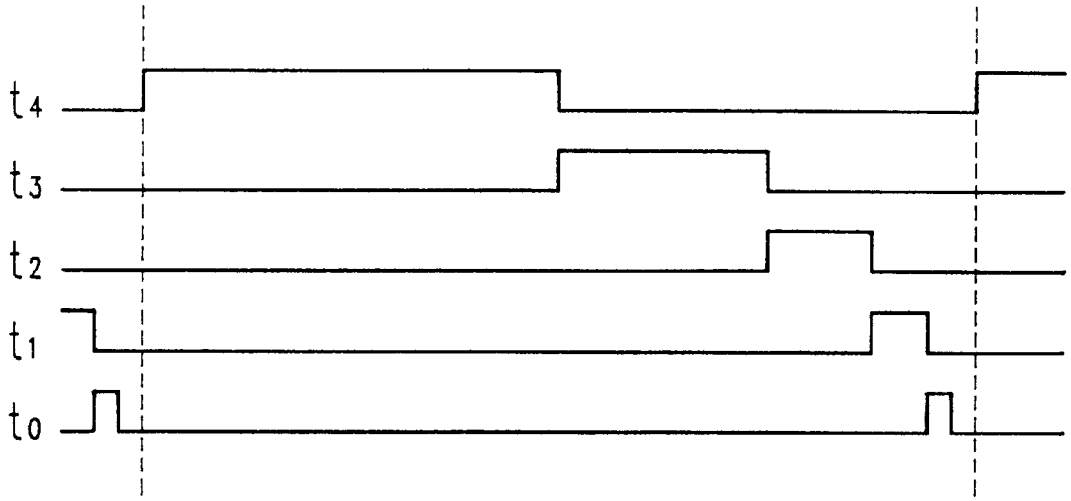
FIG. 29 is a waveform diagram illustrating waveforms of signals having different duty ratios which are input to the conventional 8-bit driving device.

FIG. 6 shows a configuration of an 8-bit driving device 300 configured as an LSI in the third example, and FIG. 7 shows a configuration of one output circuit in the 8-bit driving device 300. The 8-bit driving device 300 drives a liquid crystal display panel using the oscillating voltage method. The 8-bit driving device 300 is realized by applying the present invention to the conventional 8-bit driving device 700 shown in FIGS. 26 through 28. In FIGS. 6 through 8, the identical elements with those in the conventional 8-bit driving device 700 bear the same reference numerals therewith.

The 8-bit driving device 300 includes a plurality of output circuits 300*a*, 300*b*, . . . , each corresponding to one source line. The 8-bit driving device 300 includes nine voltage supply lines 10, 332, 364, . . . and 256 respectively for supplying nine reference gray-scale voltages V32*i* (i=0, 1, 2 . . . 8) supplied from outside the 8-bit driving device 300. The nine voltage supply lines are respectively connected to input terminals 1 through 9 at one end thereof. The input terminals 1 through 9 are provided at an end of the 8-bit driving device 300.

Among the nine voltage supply lines, the reference gray-scale voltage V0 supplied by the voltage supply line 10 has the minimum difference from the counter voltage of the liquid crystal display panel, and the reference gray-scale voltage V256 supplied by the voltage supply line 256 has the maximum difference from the counter voltage of the liquid crystal display panel. The other voltage supply lines each include a pair of signal supply lines.

For example, the voltage supply line 332 for supplying a reference gray-scale voltage V8 includes signal supply lines 332*a* and 332*b*, which are connected to each other only at the input terminal 2. The voltage supply line 364 for supplying a reference gray-scale voltage V64 includes signal supply lines 364*a* and 364*b*, which are connected to each other only at the input terminal 3.

The output circuit 300*a* corresponds to the "i"th load, and the output circuit 300*b* corresponds to the "i+1"th load. The output circuits each send a gray-scale voltage based on data signals D0 through D7 to the corresponding source line.

With reference to FIG. 7, the output circuit 300*a* will be described.

The output circuit 300*a* includes a sampling circuit 310 for sampling data signals D0 through D7 based on a control signal Tsmp, a holding circuit 320 for storing an output from the sampling circuit 310 using a control signal LS, and a selection control section 330 for outputting a gray-scale voltage having a prescribed level to the source line based on memory data d0 through d7 stored in the holding circuit 320.

The selection control section 330 includes a switch section 330*b* for switching a plurality of analog switches ASW0, ASW32*i*H, ASW32*i*L (i=1, 2, . . . 7) and ASW256, and a selection control circuit 330*a* for controlling such switching based on the memory data d0 through d7 to select prescribed two reference gray-scale voltages among the nine reference gray-scale voltages.

In detail, the analog switch ASW0 is connected to the voltage supply line 10, and the analog ASW256 is connected to the voltage supply line 256. The analog switches ASW32H and ASW32L are connected to the signal supply lines 332*a* and 332*b*, respectively. The analog switches ASW64H and ASW64L are connected to the signal supply lines 364*a* and 364*b*, respectively. The other analog switches are connected to the signal supply lines in the same manner.

Figure 8:
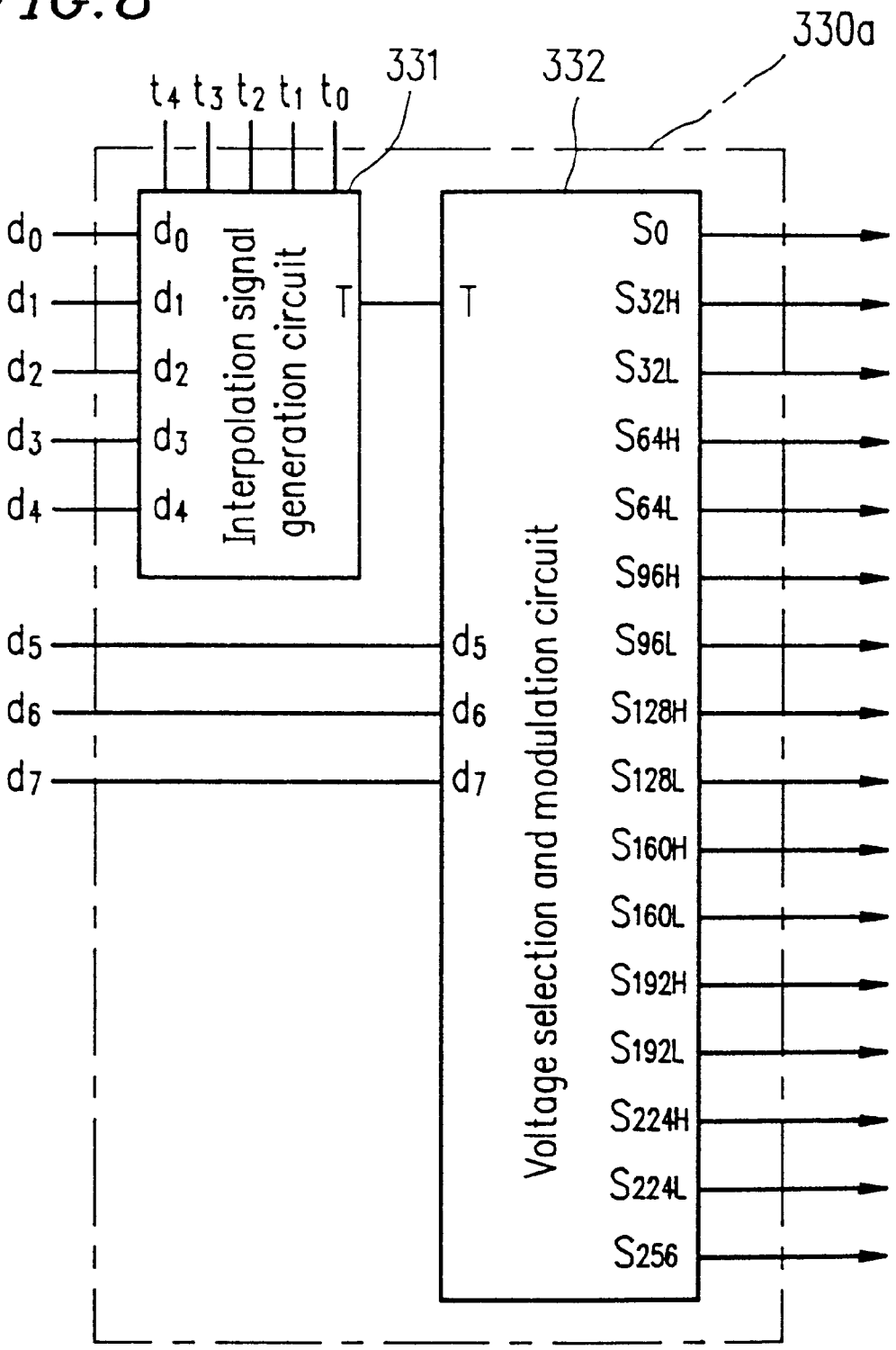
FIG. 8 is a diagram illustrating a selection control circuit in the output circuit shown in FIG. 7.

As is shown in FIG. 8, the selection control circuit 330*a* includes an interpolation signal generation circuit 331 and a voltage selection and modulation circuit 332. The interpolation signal generation circuit 331 has the same structure and logic configuration as that of the interpolation signal generation circuit 731 in the conventional 8-bit driving device 700 (FIG. 28 and Table 4A), and outputs an interpolation signal T. The selection control circuit 330*a* turns ON prescribed two analog switches based on control signals s0, s256, s32*i*H and s32*i*L (i=1, 2, . . . 7) to select the two prescribed reference gray-scale voltages and modulates the selected reference gray-scale voltages based on the interpolation signal T from the interpolation signal generation circuit 331. The voltage selection and modulation circuit 332 has a logic configuration shown in Table 7. As is appreciated from Table 7, the above-mentioned selection is performed so as to always combine, for example, each of the signal supply lines 332*a* with a supply line having a higher voltage than the voltage thereof and to combine, for example, each of the signal supply line 332*b* with a supply line having a lower voltage than the voltage thereof.

TABLE 7

| d5 | d4 | d3 | S0 | S32H | S32L | S64H | S64L | S96H | S96L | S128H | S128L | S160H | S160L | S192H | S192L | S224H | S224L | S256 |
|---|---|---|---|---|---|---|---|---|---|---|---|---|---|---|---|---|---|---|
| 0 | 0 | 0 | $\bar{T}$ | T | | | | | | | | | | | | | | |
| 0 | 0 | 1 | | | $\bar{T}$ | T | | | | | | | | | | | | |
| 0 | 1 | 0 | | | | | $\bar{T}$ | T | | | | | | | | | | |
| 0 | 1 | 1 | | | | | | | $\bar{T}$ | T | | | | | | | | |
| 1 | 0 | 0 | | | | | | | | | $\bar{T}$ | T | | | | | | |
| 1 | 0 | 1 | | | | | | | | | | | $\bar{T}$ | T | | | | |
| 1 | 1 | 0 | | | | | | | | | | | | | $\bar{T}$ | T | | |
| 1 | 1 | 1 | | | | | | | | | | | | | | | $\bar{T}$ | T |

From Table 7, the following logical expression is obtained. A logic circuit for the voltage selection and modulation circuit 332 is realized by applying such a logical expression to a logic circuit.

$$s_0 = \{0\}T$$

$$s_{32H} = \{0\}T \qquad s_{32L} = \{32\}\bar{T}$$

$$s_{64H} = \{32\}T \qquad s_{64L} = \{64\}\bar{T}$$

$$s_{96H} = \{64\}T \qquad s_{96L} = \{96\}\bar{T}$$

$$s_{128H} = \{96\}T \qquad s_{128L} = \{128\}\bar{T}$$

$$s_{160H} = \{128\}T \qquad s_{160L} = \{160\}\bar{T}$$

$$s_{192H} = \{160\}T \qquad s_{192L} = \{192\}\bar{T}$$

$$s_{224H} = \{192\}T \qquad s_{224L} = \{224\}\bar{T}$$

$$s_{256} = \{224\}T$$

where $$\{0\} = \bar{d}_7\bar{d}_6\bar{d}_5 \qquad \{32\} = \bar{d}_7\bar{d}_6 d_5$$

$$\{64\} = \bar{d}_7 d_6\bar{d}_5 \qquad \{96\} = \bar{d}_7 d_6 d_5$$

$$\{128\} = d_7\bar{d}_6\bar{d}_5 \qquad \{160\} = d_7\bar{d}_6 d_5$$

$$\{192\} = d_7 d_6\bar{d}_5 \qquad \{224\} = d_7 d_6 d_5$$

Figure 9:
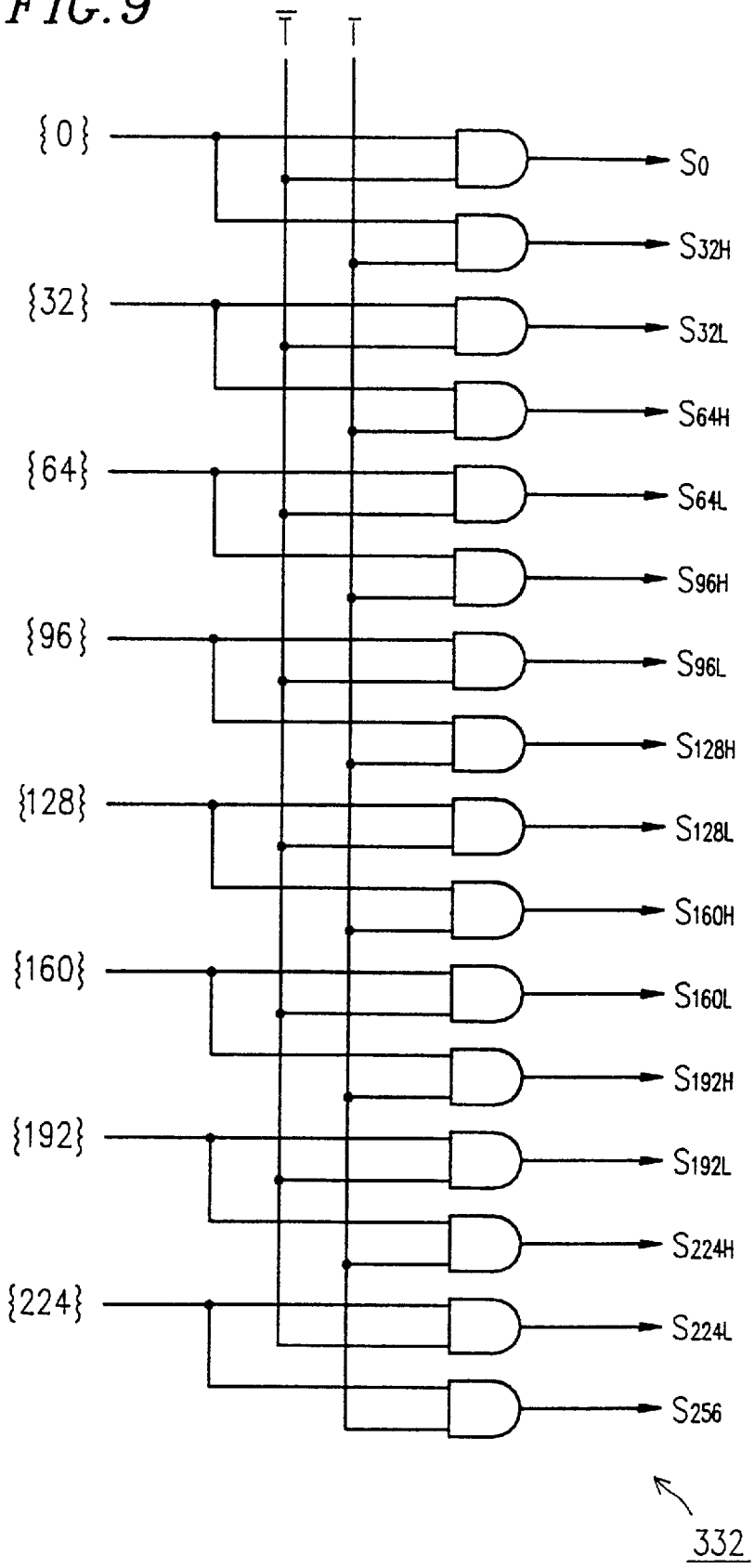
FIG. 9 is a diagram illustrating a logic circuit for a voltage selection and modulation circuit in the selection control circuit shown in FIG. 8.

FIG. 9 is a diagram of the voltage selection and modulation circuit 332 obtained using the above logical expression. The 8-bit driving device 300 having the above-described structure operates in the following manner.

For example, in the case when the reference gray-scale voltages V0 and V32 are selected in the output circuit 300*a* and the reference gray-scale voltages V32 and V64 are selected in the output circuit 300*b*, the operation of the 8-bit driving device 300 is as follows.

A current Iv32 flowing from the load to the voltage supply line 332 for supplying the reference gray-scale voltage V32 flows through the signal supply line 332*a*, and causes a voltage rise therein. The voltage rise is compensated for by a voltage drop caused by the current Iv0 flowing to the load through the voltage supply line 10. Thus, uniform interpolation gray-scale voltages V1 through V31 are applied to the pixels connected to the respective source lines.

A current Iv32' flowing to the load from the voltage supply line 332 flows through the signal supply line 332*b*, and causes a voltage drop therein. The voltage drop is compensated for by a voltage rise caused by a current Iv64 flowing from the load through the signal supply line 364*a* of the voltage supply line 364. Thus, uniform interpolation gray-scale voltages V33 through V63 are applied to the pixels connected to the respective source lines.

In the first through third examples, the following effects are obtained.

In a driving device for forming at least one interpolation gray-scale voltage between a plurality of reference gray-scale voltages which are supplied from outside the driving device, the non-uniformity in the voltage at different output terminals caused by interpolation is compensated for. Thus, crosstalk which occurs between output terminals when different interpolation gray-scale voltages are output from different output terminals is prevented. As a result, an accurate voltage is applied to the pixels connected to different source lines. Accordingly, each area of the image supplied with the same display data exhibits the same gray-scale level.

Especially in the case when the present invention is applied to a driving device used for a great number of gray-scale levels such as an 8-bit driving device, gray-scale inversion is prevented. Namely, inversion of the level of a voltage corresponding to one gray-scale level at one output terminal and the level of another voltage corresponding to another gray-scale level at another output terminal is prevented. Accordingly, accurate gray-scale display is realized.

The present invention provides a sufficient effect even when applied in a driving device used for a small number of gray-scale levels such as a 3-bit driving device.

Hereinafter, crosstalk will be explained in more detail.

Figure 30:
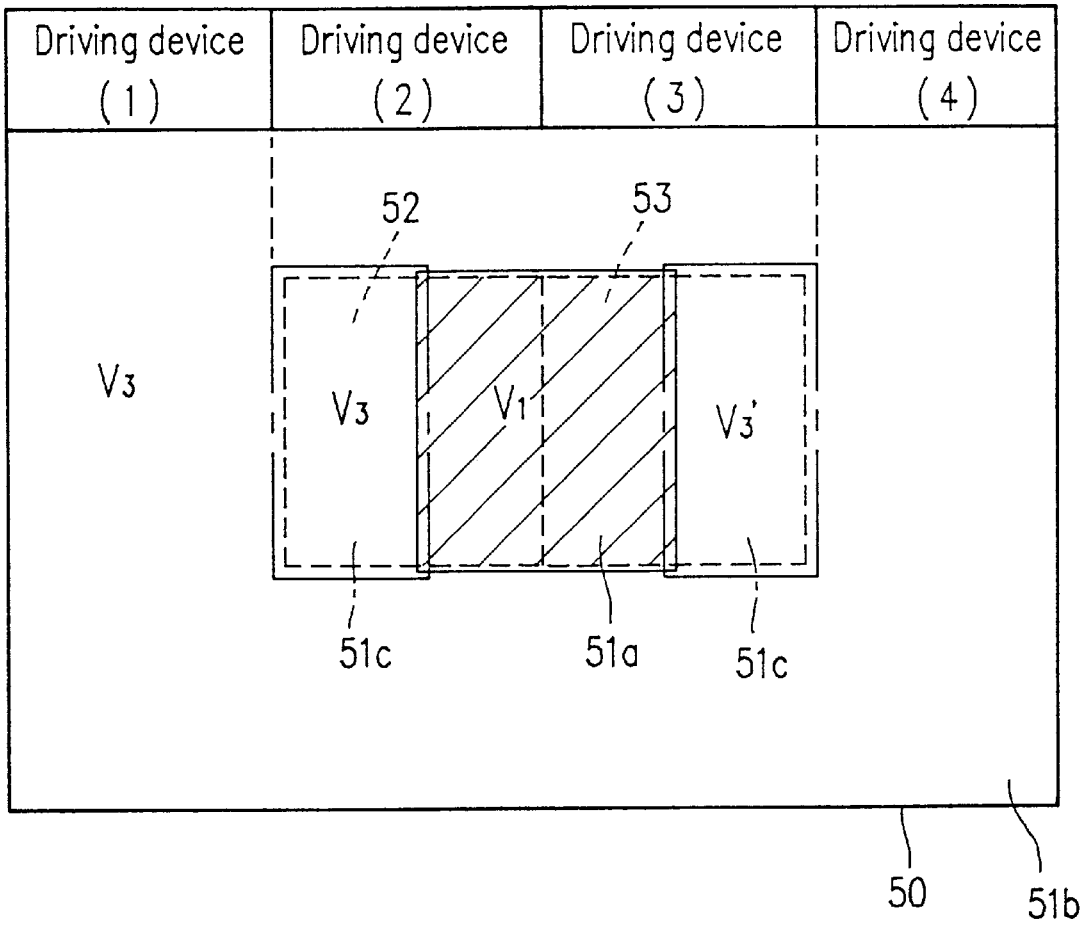
FIG. 30 is a top view of a liquid crystal display panel driven by the conventional 3-bit driving device shown in FIG. 14.

FIG. 30 shows a display state which is obtained when an image is displayed in a liquid crystal display panel 50 driven by the conventional 3-bit driving device 500.

In the following description, the liquid crystal display panel 50 is driven by four driving devices (1) through (4) for simplicity. The other components of the circuit such as a driving section on the scanning side are omitted. The liquid crystal panel 50 includes an area 51*a* surrounded by the solid line which is supplied with a gray-scale voltage V1 and an area 51*b* surrounding the area 51*a* which is supplied with a gray-scale voltage V3. The gray-scale voltage V1 is an interpolation gray-scale voltage formed using the reference gray-scale voltages V0 and V2, and the gray-scale voltage V3 is an interpolation gray-scale voltage formed using the reference gray-scale voltages V2 and V5.

An area 52 driven by the driving device (2) (surrounded by the dashed line) includes a part of the area 51*a* and a part of the area 51*b*. An area 53 driven by the driving device (3) (surrounded by the dashed line) also includes a part of the area 51*a* and a part of the area 51*b*.

As is described above regarding the prior art, the driving devices (2) and (3) operate in the following manner for forming an interpolation gray-scale voltage V3. In the voltage supply line for supplying the reference gray-scale voltage V5, a voltage rise occurs. However, in the voltage supply line for supplying the reference gray-scale voltage V2, a voltage drop is counteracted by a voltage rise caused by the current flowing from the output terminal for outputting the interpolation gray-scale voltage V1. As a result, a voltage V3' which is higher than the voltage V3 and closer to the voltage V1 than the voltage V3 is applied to areas 51*c* (surrounded by the chain line). Accordingly, the gray-scale level in the area 51*c* is different from the gray-scale level in the area 51*b*, namely, is closer to the gray-scale level of the area 51*a* than the gray-scale level of the areas 51*b*.

According to the present invention, such a phenomenon which is referred to as crosstalk is prevented. Therefore, even if an image having a plurality of areas having different gray-scale levels is formed by one driving device, each area of the image supplied with the same display data exhibits the same gray-scale level.

EXAMPLE 4

A method for generating an interpolation gray-scale voltage is not limited to the oscillating voltage method. In a fourth example according to the present invention, a resistance division method is used to form interpolation gray-scale voltages.

A 6-bit driving device 400 in the fourth example will be described with reference to FIGS. 10, 11, 12A and 12B.

Figure 10:
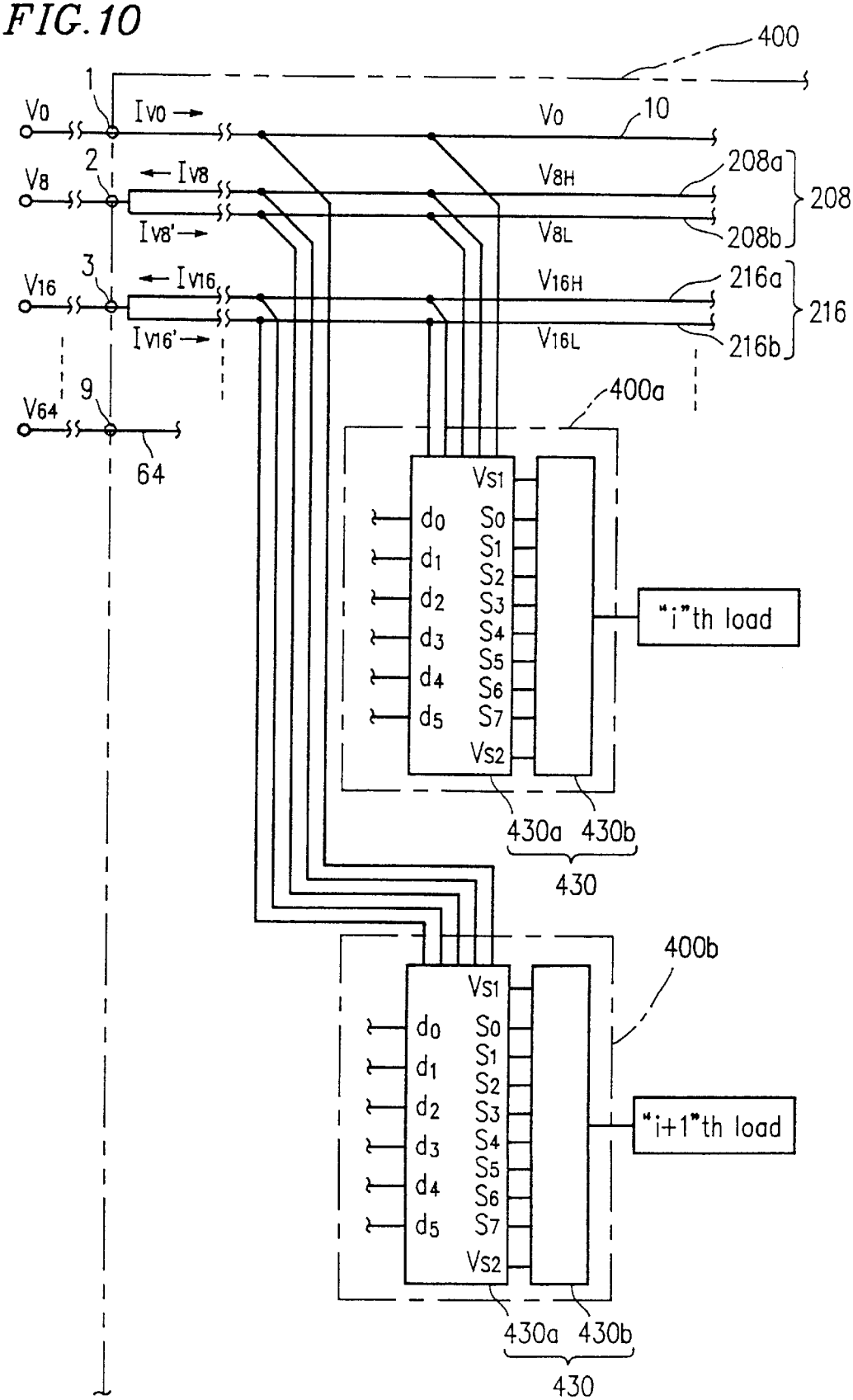
FIG. 10 is a diagram illustrating a part of a 6-bit driving device in a fourth example according to the present invention.
Figure 11:
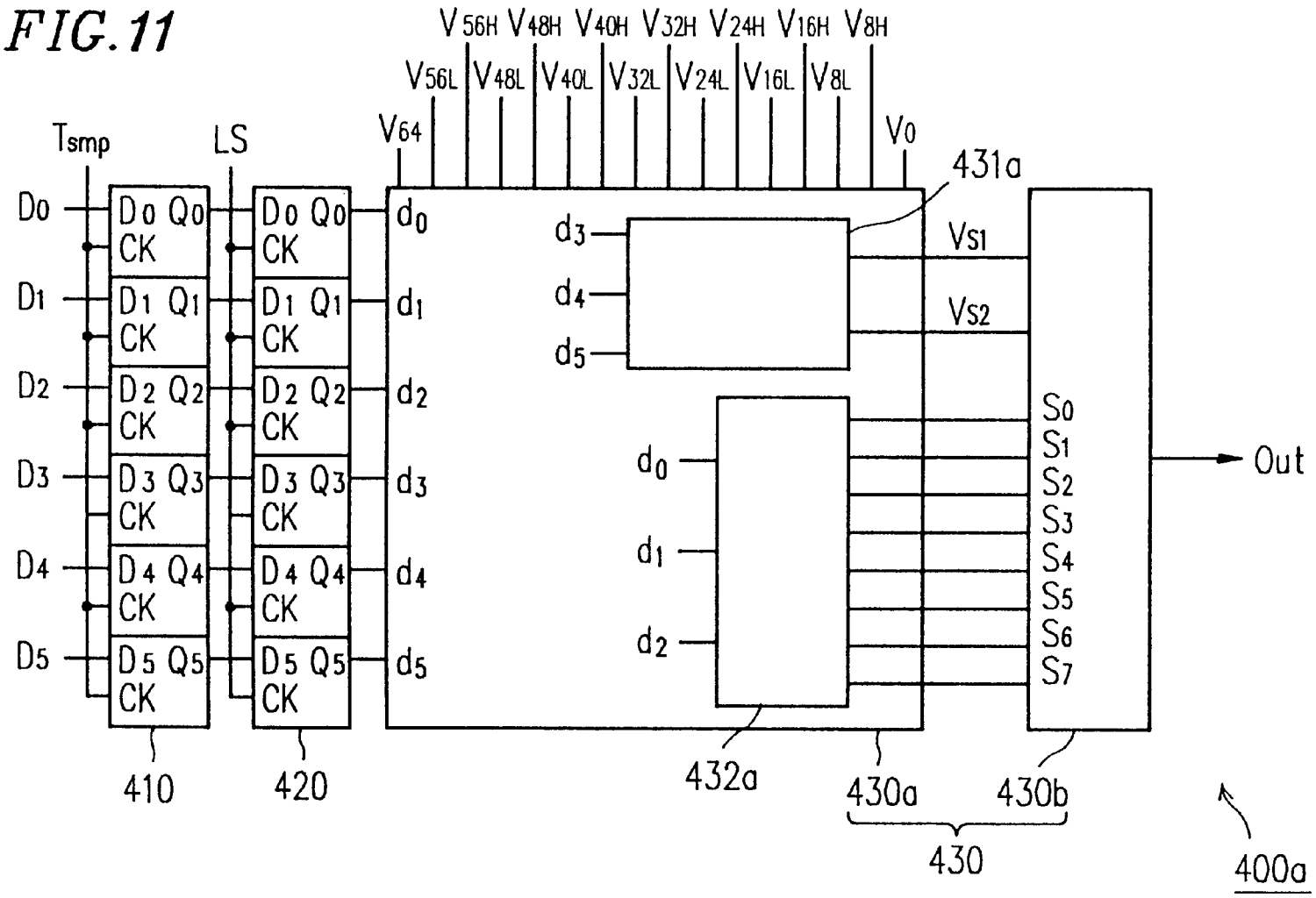
FIG. 11 is a diagram illustrating one of a plurality of output circuits of the 6-bit driving device shown in FIG. 10.

FIG. 10 shows a configuration of a 6-bit driving device 400 configured as an LSI in the fourth example, and FIG. 11 shows a configuration of one output circuit in the 6-bit driving device 400. In FIGS. 10, 11, 12A and 12B, the identical elements as those in the 6-bit driving device 200 in the second example bear the same reference numerals therewith.

The 6-bit driving device 400 includes a plurality of output circuits 400*a*, 400*b*, . . . , each corresponding to one source line. The 6-bit driving device 400 includes nine voltage supply lines 10, 208, 216, . . . 256 and 64 respectively for supplying nine reference gray-scale voltages V8*i* (i=0, 1, 2 . . . 8) supplied from outside the 6-bit driving device 400. The nine voltage supply lines are respectively connected to input terminals 1 through 9 at one end thereof. The input terminals 1 through 9 are provided at an end of the 6-bit driving device 400.

Among the nine voltage supply lines, the reference gray-scale voltage V0 supplied by the voltage supply line 10 has the minimum difference from the counter voltage of the liquid crystal display panel, and the reference gray-scale voltage V64 supplied by the voltage supply line 64 has the maximum difference from the counter voltage of the liquid crystal display panel. The other voltage supply lines each include a pair of signal supply lines.

For example, the voltage supply line 208 for supplying a reference gray-scale voltage V8 includes signal supply lines 208*a* and 208*b*, which are connected to each other only at the input terminal 2. The voltage supply line 216 for supplying a reference gray-scale voltage V16 includes signal supply lines 216*a* and 216*b*, which are connected to each other only at the input terminal 3.

The output circuit 400*a* corresponds to the "i"th load, and the output circuit 400*b* corresponds to the "i+1"th load. The output circuits each send a gray-scale voltage based on data signals D0 through D5 to the corresponding source line.

With reference to FIG. 11, the output circuit 400*a* will be described.

The output circuit 400*a* includes a sampling circuit 410 for sampling data signals D0 through D5 based on a control signal Tsmp, a holding circuit 420 for storing an output from the sampling circuit 410 using a control signal LS, and a selection control section 430 for outputting a gray-scale voltage having a prescribed level to the source line based on memory data d0 through d5 stored in the holding circuit 420.

The selection control section 430 includes a selection control section 430*a* for selecting two prescribed supply lines among the above-mentioned supply lines and outputting control signals s0 through s7 for analog switches, and a switch section 430*b* for receiving the reference gray-scale voltages in the two selected supply lines through input terminals 431*b* and 432*b* (shown in FIG. 12A) respectively and dividing the resistance of each reference gray-scale voltage based on the control signals s0 through s7.

Figure 12A:
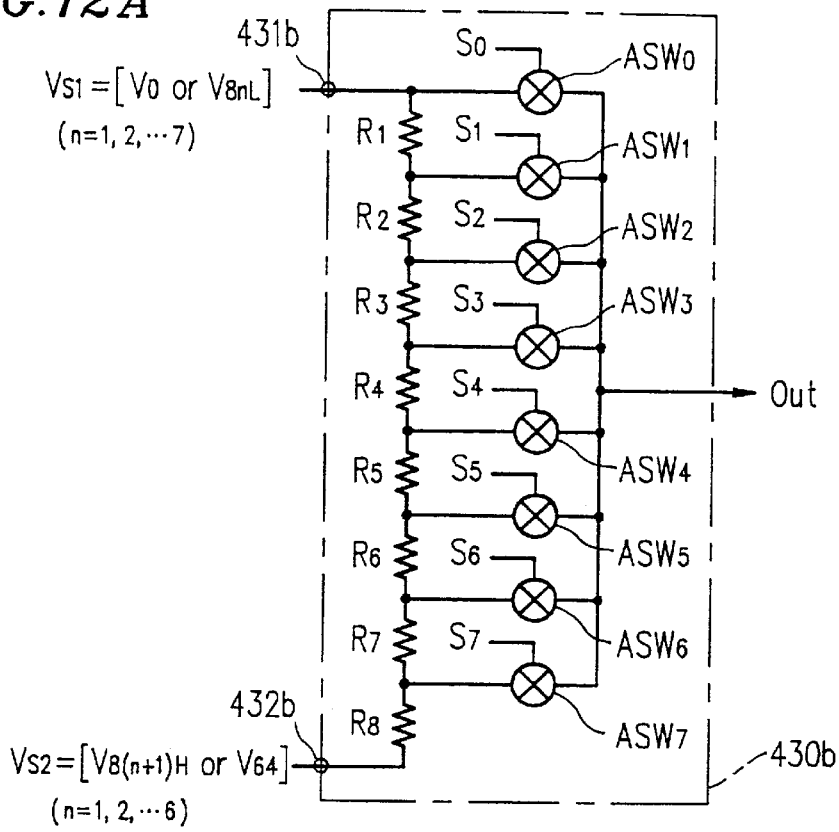
FIGS. 12A and 12B are diagrams illustrating a switch section in the output circuit shown in FIG. 11.

As is shown in FIG. 12A, the switch section 430*b* includes eight resistors R1 through R8 connected in series between the input terminals 431*b* and 432*b*, an analog switch ASW0 connected between the input terminal 431*b* and an output terminal, and analog switches ASW1 through ASW7. Each of the analog switches ASW1 through ASW7 are connected between the connection point of two adjacent resistors and the output terminal. The resistors R1 through R8 each have a resistance r.

As is shown in FIG. 11, the selection control circuit 430*a* includes a supply line selection circuit 431*a* and a switch control circuit 432*a*. The supply line selection circuit 431*a* selects a pair of adjacent supply lines based on the upper 3 bits of the 6-bit memory data d0 through d5 and outputs the voltages of the selected supply lines as voltages Vs1 and Vs2 for forming an interpolation gray-scale voltage. The switch control circuit 432*a* activates one of the control signals s0 through s7 for the analog switches ASW0 through ASW7 based on the lower 3 bits of the memory data d0 through d5 and thus turns ON the corresponding analog switch.

For example, in the case when the display data is 4 (d2=1; d0, d1, and d3 through d6=0), the supply line selection circuit 431*a* selects the reference gray-scale voltages V0 and V8H based on the upper 3 bits d3, d4 and d5 and sends the voltages V0 and V8H respectively to the input terminals 431*b* and 432*b*. Simultaneously, the switch control circuit 432*a* activates one of the control signals s0 through s7 based on the lower 3 bits d0, d1 and d2 and thus turns ON the corresponding analog switch. Since the display data is 4, the control signal s4 is activated, and thus only the analog switch ASW4 is turned ON.

Figure 12B:
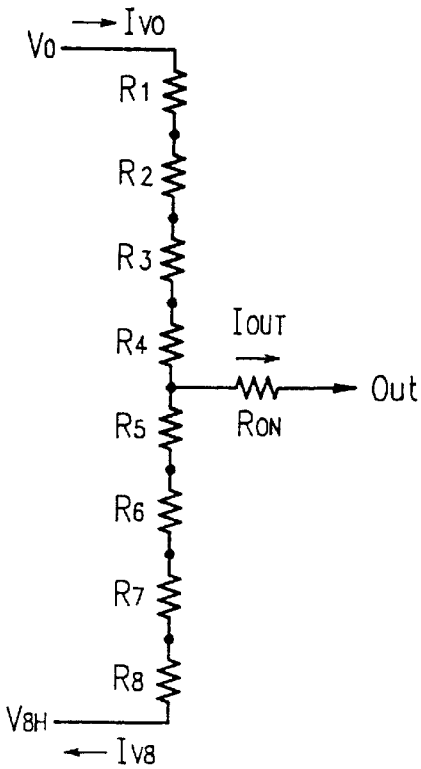

FIG. 12B is a diagram of an equivalent circuit in this case. In FIG. 12B, symbol RON denotes an ON resistance of the analog switch.

When a sufficient length of time has passed after a transition period, the current IOUT flowing between the load and the supply line becomes substantially zero. Accordingly, a voltage VOUT which is obtained as a result of voltage division performed by eight resistances is output from the output circuit as is expressed by the following equation.

$$VOUT=(4V0+4V8)/8$$

At this point, the currents Iv0 and Iv8 having the same absolute value flow in the voltage supply line 10 (V0) and the signal supply line 208*a* of the voltage supply line 208 (V8) in opposite directions to each other.

$$Iv0=Iv8=(V8-V0)/8r$$

If V0>V8, such currents cause a voltage drop in the voltage supply line 10 and a voltage rise in the signal supply line 208*a*.

The 8-bit driving device 400 having the above-described structure operates in the following manner.

For example, in the case when the reference gray-scale voltages V0 and V8 are selected in the output circuit 400*a* and the reference gray-scale voltages V8 and V16 are selected in the output circuit 400*b*, the operation of the 8-bit driving device 400 is as follows.

The current Iv8 flowing from the load to the voltage supply line 208 for supplying the reference gray-scale voltage V8 flows through the signal supply line 208*a* and causes a voltage rise therein. Such a voltage rise is compensated for by a voltage drop caused by the current Iv0 flowing to the load through the voltage supply line 10. As a result, an interpolation gray-scale voltage V5 is accurately supplied to the pixels connected to the source lines.

The current Iv8' flowing to the load in the voltage supply line 208 flows through the signal supply line 208*b* and causes a voltage drop therein. Such a voltage drop is compensated for by a voltage rise caused by the current Iv16 flowing from the load through the signal supply line 216*a* of the voltage supply line 216. As a result, an interpolation gray-scale voltage V11 is accurately supplied to the pixels connected to the source lines.

As has been described so far, according to the present invention, the voltage supply lines each includes a first signal supply line and a second signal supply line except for the voltage supply lines for supplying voltages having the maximum and the minimum differences from the voltage of the common electrode of the liquid crystal display panel. The first signal supply line is combined with a supply line having a voltage higher than the voltage thereof, and a second signal supply line is combined with a supply line having a voltage lower than the voltage thereof. Due to such a structure, in each voltage supply line, a current component flows to the load through the first signal supply line whereas a current component flows from the load through the second signal supply line. Accordingly, in the case when two reference gray-scale voltages are used to form an interpolation gray-scale voltage which is intermediate between the two reference gray-scale voltages, a current flowing from the load and a current flowing to the load are not mixed together in one voltage supply line. Therefore, a voltage drop or a voltage rise occurs normally in each of the signal supply lines and the voltage supply lines. Thus, crosstalk which occurs between the output terminals of such two supply lines when different interpolation gray-scale voltages are output is prevented. As a result, each area of the image supplied with the same display data has the same gray-scale level.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit used in a display apparatus, comprising:

a plurality of output circuits each for selecting two reference gray-scale voltages among a plurality of different reference gray-scale voltages based on display data and outputting an interpolation voltage corresponding to the display data using the two reference gray-scale voltages; and a plurality of voltage supply lines for respectively supplying the plurality of reference gray-scale voltages, the plurality of voltage supply lines including a first voltage supply line which supplies a reference gray-scale voltage having a minimum difference from the voltage of a common electrode of the display apparatus, a second voltage supply line which supplies a reference gray-scale voltage having a maximum difference from the voltage of the common electrode, and at least one additional voltage supply line, each of the at least one additional voltage supply line supplying a corresponding different reference gray-scale voltage and comprising a first signal supply line and a second signal supply line which both supply the corresponding different reference gray-scale voltage, and the two reference gray-scale voltages selected by each of the output circuits are supplied by one of a plurality of pairs of voltage supply lines, the one of the plurality of pairs of voltage supply lines being selected from among (i) the first voltage supply line, and a first signal supply line included among the at least one additional voltage supply line and having a voltage lower than the voltage in the first voltage supply line; (ii) a second signal supply line, and a first signal supply line included in one of the at least one additional voltage supply line different from another of the at least one additional voltage supply line to which the second signal supply line belongs; and (iii) the second voltage supply line, and a second signal supply line included among the plurality of signal supply lines and having a voltage higher than the voltage in the second voltage supply line.

2. A driving circuit according to claim 1, wherein the first and second signal supply lines in each of the at least one additional voltage supply line have substantially an identical electric characteristic.

3. A driving circuit according to claim 1, wherein the first and second signal supply lines in each of the at least one additional voltage supply line are electrically connected to each other to provide respective paths for currents flowing to and from a load in a steady state after a transition period.

4. A driving circuit according to claim 1, wherein the plurality of output circuits each forms an interpolation gray-scale voltage by an oscillating voltage method.

5. A driving circuit according to claim 2, wherein the plurality of output circuits each forms an interpolation gray-scale voltage by an oscillating voltage method.

6. A driving circuit according to claim 3, wherein the plurality of output circuits each forms an interpolation gray-scale voltage by an oscillating voltage method.

7. A driving circuit according to claim 1, wherein the plurality of output circuits each forms an interpolation gray-scale voltage by a resistance division method.

8. A driving circuit according to claim 2, wherein the plurality of output circuits each forms an interpolation gray-scale voltage by a resistance division method.

9. A driving circuit according to claim 3, wherein the plurality of output circuits each forms an interpolation gray-scale voltage by a resistance division method.

10. A liquid crystal display apparatus for forming an image using a liquid crystal material, the liquid crystal display apparatus comprising:

a liquid crystal display panel including a plurality of loads; and a driving circuit for driving the plurality of loads by a gray-scale voltage based on display data, the driving circuit including:

a plurality of output circuits each for selecting two reference gray-scale voltages among a plurality of difference reference gray-scale voltages based on display data and outputting an interpolation voltage corresponding to the display data using the two reference gray-scale voltages; and a plurality of voltage supply lines for respectively supplying the plurality of reference gray-scale voltages, the plurality of voltage supply lines including a first voltage supply line which supplies a reference gray-scale voltage having a minimum difference from the voltage of a common electrode of the display apparatus, a second voltage supply line which supplies a reference gray-scale voltage having a maximum difference from the voltage of the common electrode, and at least one additional voltage supply line, each of the at least one additional voltage supply line supplying a corresponding different reference gray-scale voltage and comprising a first signal supply line and a second signal supply line which both supply the corresponding different reference gray-scale voltage, and the two reference gray-scale voltages selected by each of the output circuits are supplied by one of a plurality of pairs of the voltage supply lines, the one of the plurality of pairs of the voltage supply lines being selected from among (i) the first voltage supply line, and a first signal supply line included among the at least one additional voltage supply line and having a voltage lower than the voltage in the first voltage supply line; (ii) a second signal supply line, and a first signal supply line included in one of the at least one additional voltage supply line different from another of the at least one additional voltage supply line to which the second signal supply line belongs; and (iii) the second voltage supply line, and a second signal supply line included among the plurality of signal supply lines and having a voltage higher than the voltage in the second voltage supply line.

* * * * *